US005505654A

United States Patent [19]

Wood et al.

[11] Patent Number: 5,505,654

[45] Date of Patent: Apr. 9, 1996

[54] LENS BLOCKING APPARATUS

[75] Inventors: Kenneth O. Wood, West Stafford; Jeffrey J. Murray, Ellington; Jonathan M. Dooley, Newington; Richard P. Tinson, Hebron; John E. Ladue, Tolland; Robert J. Pavone, South Windsor, all of Conn.

[73] Assignee: Gerber Optical, Inc., South Windsor, Conn.

[21] Appl. No.: 117,733

[22] Filed: Sep. 7, 1993

[51] Int. Cl.[6] ..... B24B 13/005

[52] U.S. Cl. ..... 451/6; 451/5; 451/460

[58] Field of Search ..... 451/6, 5, 460, 451/364, 390, 1, 8, 9

[56] References Cited

U.S. PATENT DOCUMENTS

| | | | |
|---|---|---|---|
| 2,253,954 | 8/1941 | Goddu | 451/460 |
| 3,304,586 | 2/1967 | Buckminster et al. | 451/460 |
| 3,354,938 | 11/1967 | Carignan et al. | 451/460 |
| 3,383,808 | 5/1968 | Deshayes et al. . | |
| 3,431,688 | 3/1969 | Rudd et al. | 451/460 |
| 3,448,549 | 6/1969 | McCall . | |
| 3,451,177 | 6/1969 | Buckminster et al. | 451/460 |
| 4,319,846 | 3/1982 | Henry et al. | 356/401 |
| 4,330,203 | 5/1982 | Oppenheim et al. | 356/127 |
| 4,479,332 | 10/1984 | Stern et al. | 451/43 |
| 4,737,918 | 4/1988 | Langlois et al. | 451/6 |
| 5,283,980 | 2/1994 | Lohrenz et al. | 451/5 |

FOREIGN PATENT DOCUMENTS

| | | | |
|---|---|---|---|
| 409760 | 1/1991 | European Pat. Off. . | |
| 1577502 | 1/1970 | Germany . | |
| 2622723 | 5/1977 | Germany | 451/460 |

*Primary Examiner*—Robert A. Rose
*Attorney, Agent, or Firm*—McCormick, Paulding & Huber

[57] ABSTRACT

An apparatus for blocking an ophthalmic lens blank for working the lens includes an alignment station for supporting and aligning the lens blank relative to a target image and a transport means for moving the lens from the alignment station to a blocking station while maintaining lens orientation. The blocking station includes a support for a lens block, support for the lens, and a mechanism for injecting heated liquid bonding material between lens and block which solidifies on cooling to join the lens and block.

53 Claims, 20 Drawing Sheets

LENS BLOCKING APPARATUS

CROSS REFERENCE RELATED TO APPLICATION

This application relates to co-pending U.S. application Ser. No. 07/717,685 entitled IMPROVED DISPOSABLE LAP BLANK filed in the name of Ken Wood on Jun. 19, 1991, and which application being commonly assigned with the assignee of the present invention.

BACKGROUND OF THE INVENTION

This invention relates to a blocking apparatus for an ophthomalic lens blank of the type having a finished exteriorly disposed outer surface and an interiorly disposed inner surface capable of being machined to satisfy a given prescription, and deals more particularly with an apparatus for automatically blocking by bonding the exteriorly disposed outer surface of the lens blank to a block in precise orientation relative to reference structure on the block so that the block can be mounted directly to an automated surfacing generator where the inner surface is machined in correct orientation to the outer surface to achieve the desired prescription.

In the creation of a lens surface using automated surfacing generating systems, such as disclosed in U.S. Pat. No. 4,989,316 issued to Logan et al., data describing prescription information is transmitted to the computer of the surface generating system, and is thereafter used by the machine to cut the interiorly disposed surface of the lens to create the desired lens. The machine disclosed in this patent, as well as with other such machines that are presently in the marketplace, require that the finished outer surface of the lens blank be bonded to a block for holding the lens so that it can be placed in the surfacing machine during a cutting operation and in a lapping machine during the fining and polishing process.

Previous methods for lens blocking require manual alignment of the lens with a universal grid in accordance with axis and centering data for a prescription and marking the lens with ink to create reference marks for the actual blocking operation. At the blocking device, these marks are visually aligned with the block and a low melting point metal alloy is injected between lens and block to bond the two together. Thus, it can be seen that there are two manual alignments, the first involving visual information of a universal grid and the markings that are made on the lens relative to this grid and the second being the actual alignment of these markings with corresponding reference points on the blocking station. Among the drawbacks associated with such prior art methods is the necessity for each alignment to be made by a skilled operator. In addition, the metal alloy used to bond the lens blank to the block includes such elements as bismuth, tin, cadmium and lead, which materials are toxic and environmentally hazardous. Also, the characteristics of the molten alloy are such that the surface of the lens blank to which the alloy is bonded to, must be treated, for example, by precoating the outer surface of the lens as a means of improving adhesion of these bonding agents.

In addition, it is essential that the lens blank outer surface and the block are bonded in precise alignment with one another in accordance with prescription data because the surface generator machines the inner surface with reference to the block, and the correct prescription can be achieved only if the inner surface of the lens is aligned correctly with the outer confronting surface of the block. This relative positioning of the block and the lens opposing surfaces affects the accuracy of obtaining a desired lens thickness, since this outcome is dependent on the spacing of the block and the outer surface of the lens. Also, prismatic power depends on centering and skewing of the block on the outer surface of the lens. Cylinder power axis, required for astigmatism correction, depends on angular orientation of the block relative to any multifocal elements on the outer surface of the lens. Thus, a number of factors influence the relative positioning of the lens blank relative to the block.

Previous lens mounting blocks limited the type of lens surfaces which could be cut in the involved lens blank. That is, in these previously known blocks, the lens blank was supported by portions of the block which projected from it so that only a partial gap was provided to space the lens blank from the block. Because these projecting block portions supported the lens blank about its periphery, they did not allow the lens to be machined to a zero thickness in areas of the lens which overlie them, such as in the case of a "feathered" lens shape. Even if these projections did not interfere with such surfacing processes, the alloy bonding material which holds the lens blank to the block, would not lend itself to being readily cut by the cutting tool given its hardness and the inherent toxicity attributable to having metallic shavings released into a work environment.

It is therefore an object of the invention to provide an apparatus of the aforementioned type in which alignment of the lens blank relative to a given orientation on a blocking part is accomplished by material viewing without sighting devices thereby eliminating the heretofore known problem of viewing parallax.

Still a further object of the invention is to provide an automated blocking system whereby a user is may conduct an alignment procedure on one blank while simultaneously conducting a blocking operation on another.

A further object in the invention is to provide a system whereby prescription data describing the orientation of a lens surface to be machined relative to the block it is to be bonded to is stored in a host computer and is on-demand downloaded from the host to an apparatus of the type heretofore discussed.

It is still a further object of the invention to provide a machinable bonding agent for bonding in a lens blank and block assembly so as to support the lens blank such that up to zero thickness cuts can be made in the blank about its periphery without cutting the block.

Yet still a further object of the invention is to provide an apparatus capable of the bonding a lens blank with the block using various bonding agents, including low melting point thermoplastic, through management of temperature and pressure during the injection and curing cycle and to provide such a bonding agent which eliminates the need for precoating the outer surface of the lens as a means of improving adhesion of the bonding agent.

Another object of the invention is to provide a blocking system which provides a uniform support for the lens blank to assure aberration free surface generation and polishing.

Still a further object of the invention is to provide a block position sensing support which during a bonding operation detects incorrect positioning of the block in the apparatus thereby stopping the process to avoid blocking in unwanted prismatic power and incorrect lens thickness.

A further object of the invention is to provide a block positioning support whereby the block is automatically moved to a designated angular orientation to align the prescription cylinder axis.

SUMMARY OF THE INVENTION

The invention resides in an apparatus and related method for automated blocking of an ophthalmic lens blank to a block for working the lens. The apparatus comprises a base and a means supported on the base for displaying a target image for a given orientation of a lens blank relative to the base. An alignment station is provided and is supported by the base for supporting and aligning a lens blank relative to the target image. Along with the alignment station, a blocking station is also provided and is supported by the base for receiving and supporting a block in a given orientation relative to the base. A transport means is located intermediate and adjacent the alignment and blocking stations for moving the lens blank from the alignment station to the blocking station while maintaining lens blank orientation established at the alignment station. The blocking station includes a blocking support for the lens block, a lens blank support, and a means for injecting heated liquid bonding material between lens and block which solidifies on cooling to join the lens blank and the block to one another.

DETAILED DESCRIPTION OF THE PREFERRED EMBODIMENT

Figure 1A:
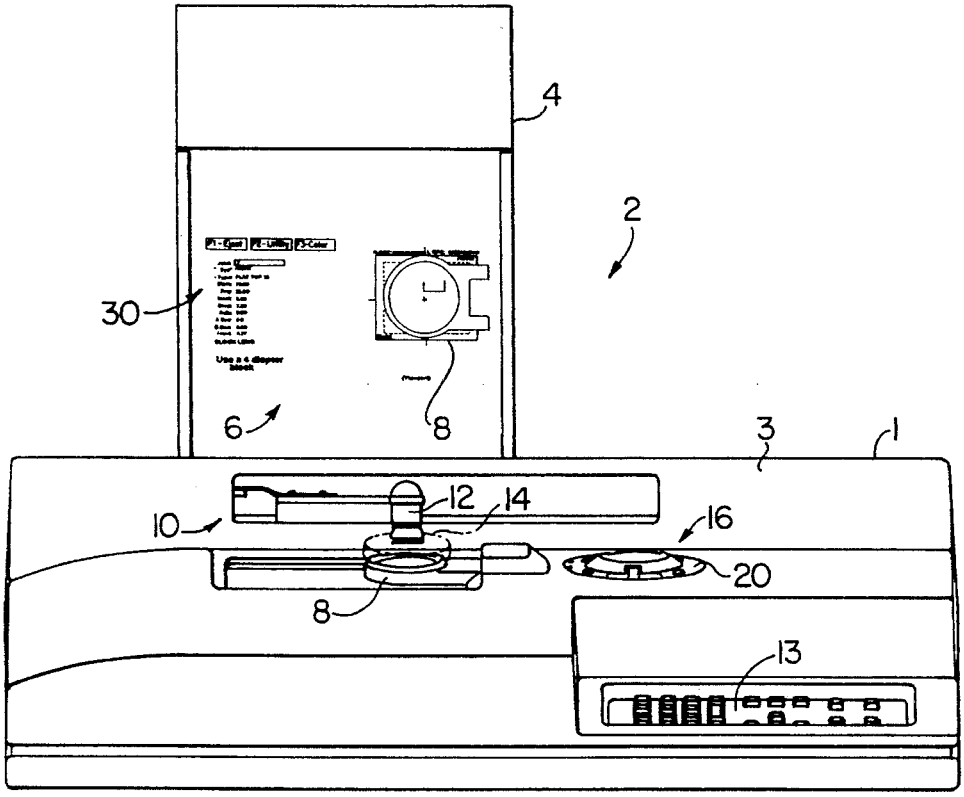
FIG. 1*a* is a front elevation view of the automated blocking apparatus as covered by its housing.
Figure 1B:
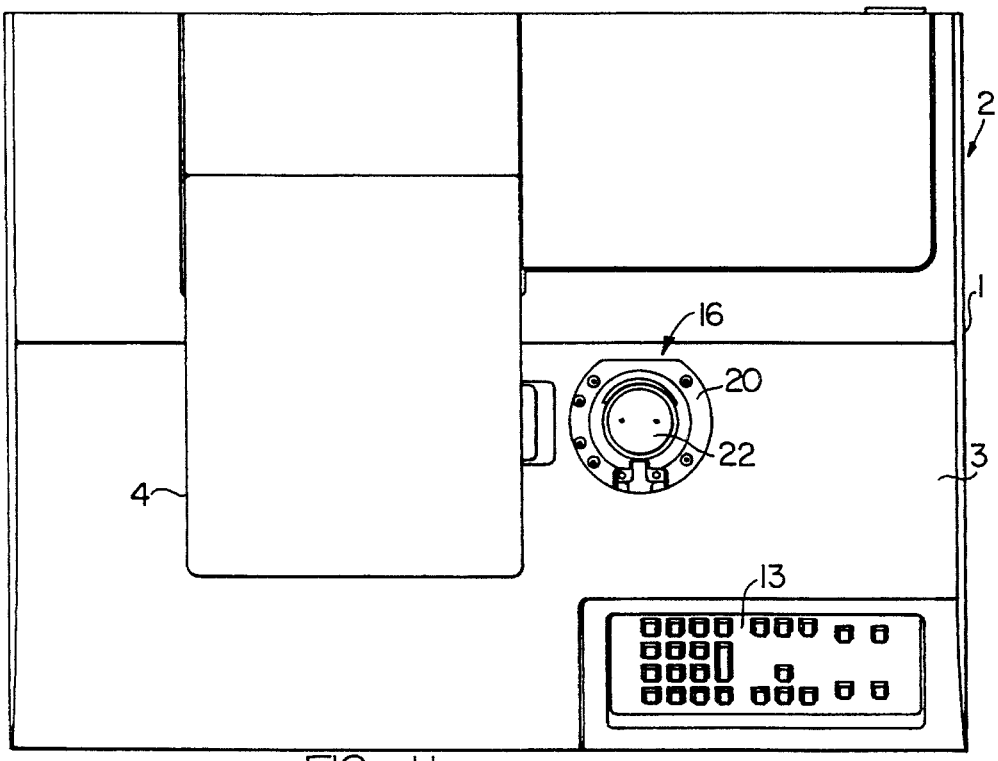
FIG. 1*b* is a top plan view of the apparatus of FIG. 1.

FIG. 1 illustrates an automated lens blocking apparatus generally illustrated as 2 embodying the present invention. The apparatus is of the type which can be placed on a support, such as, the flat surface of a table, and operated by a user if desired while sitting. A housing 3 encloses the apparatus giving the apparatus a streamlined, low profile look. A user interface is provided in the form of a keypad 13 which is linked to appropriate controls in the apparatus to cause automatic blocking of a lens blank to an associated block in a manner which is provided in accordance with the invention.

Figure 2:
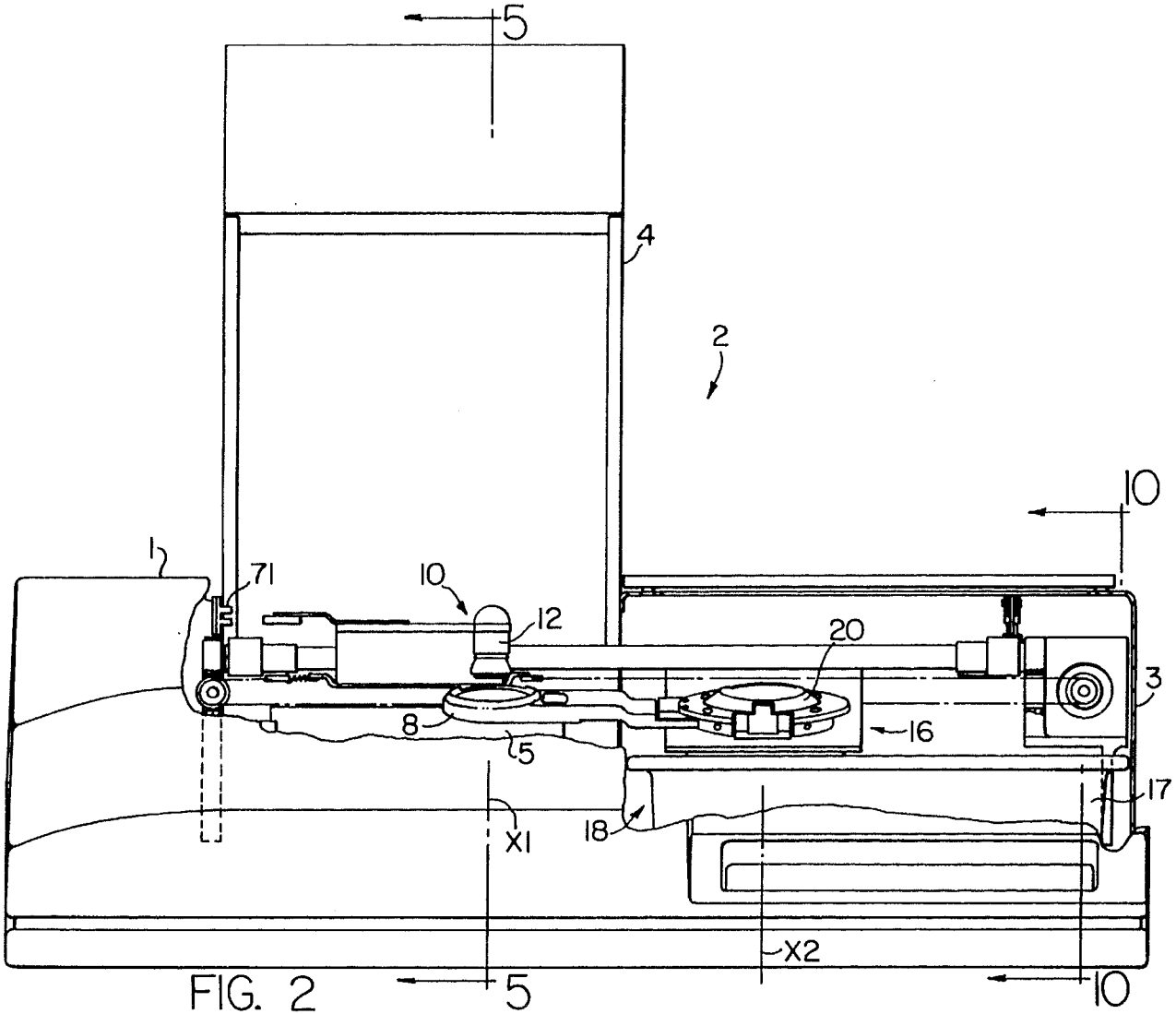
FIG. 2 is a front elevation view of the automated blocking apparatus with the housing removed.
Figure 3:
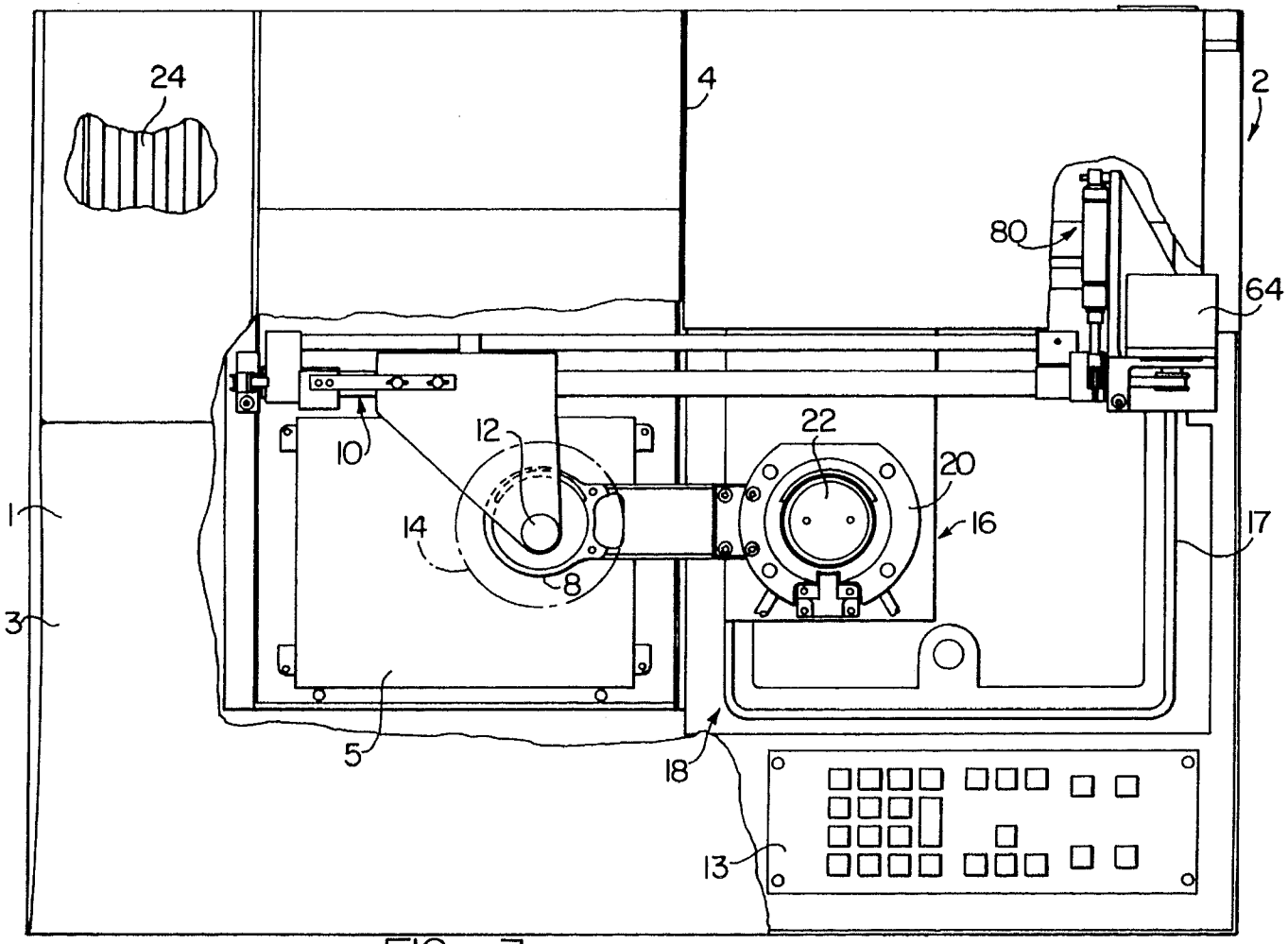
FIG. 3 is a top plan view of the automated blocking apparatus with the housing removed.

As best illustrated in FIGS. 1–3, the apparatus 2 is comprised of a base 1 with a display screen 5 and an alignment support ring 8 having an upwardly directed annular edge for supporting a lens blank 14, each supported on the base, and above which screen is disposed an optical tower 4 which presents the user with a projected alignment template 6 created by the display screen and on which is superimposed a projection of an alignment support ring 8. A pick and place means 10 is also provided and includes a releasable gripping means 12 controllably positionable between a first location X1 located coincidentally with the alignment support ring 8 and a second location X2 located coincidentally with a blocking station 16, with the pick and place means 10 further being provided with means capable of lifting the lens blank 14 off the alignment support ring 8 and transporting it to the blocking station 16 disposed generally adjacent the ring 8. The blocking station includes a support 20 for supporting a lens block 22 to be bonded to an associated lens blank and a reservoir means 18 having a supply of bonding material in liquid form provided to releasably secure the lens blank to the block at the blocking station. The reservoir means includes a tub-like member 17 defined by a base 19 and four side walls 21,21 opening upwardly so adapted to contain a bath of the liquified blocking material. Operations of the apparatus are controlled by a central controller 24 linked to the display screen 5, the pick and place transport means 10 and the appropriate subcontrol systems associated with the blocking station 16.

Figure 4:
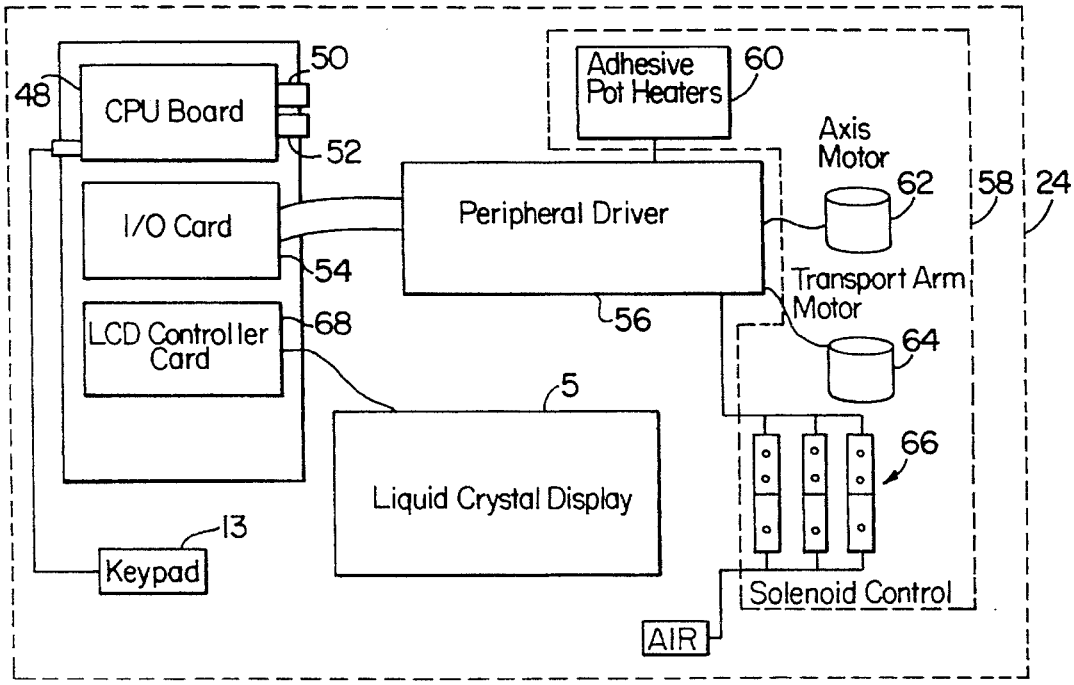
FIG. 4 is a schematic of the central control system.

The central controller 24 as illustrated in FIG. 4 is provided as part of the apparatus 2 and is housed within the housing 28 and is connected to the keypad 13 for data input purposes and operation controls. The system includes a central processing unit 48 which, in the illustrated example, is comprised of a 286 CPU board with a 1.44 Megabyte ROM disk on which is encoded the EXECUTABLE program for the automatic lens blocking operation. The CPU board further includes 640 Kilobytes of RAM which is linked to the ROM disk through appropriate bus work such that the ROM program is downloaded to RAM as a part of a start up procedure. Also linked to the CPU board 48 are serial ports 50 and 52 connectable to external data providing sources. Among these sources is an external reader, such as a bar code scanner, which scans job number which may for example be printed on the holding box of the lens to be worked. The other is connectable to a host computer in which a data base of particular job files including the needed descriptive information for each job is stored.

The central controller 24 further includes an input/output sub-controller 54 linked to a peripheral driver 56 for driving peripheral devices 58, such as bonding material, heaters 60,60 associated with the reservoir means 17, an axis motor 62 associated with the blocking station 16, a traveler arm positioning drive motor 64 associated with the pick and place means 10 and a bank 66,66 of solenoid actuated valves each individually separately activatable to introduce pressurized air to respective air activated devices, such as actuators as well as being responsible for controlling the flow of bonding material at the blocking station 16. The central control 24 also includes a LCD sub-controller 68 linked to the display screen 5 for causing the projected alignment template to be displayed on the screen in accordance with data prescribing the characteristics of the displayed image. The keypad 13 which is primarily provided for the user to prompt certain commands by depressing keys to cause, for example, transport of the blank to the blocking station, also allows the user to edit or manually enter data otherwise downloaded for example, from a host computer or entered by scanning.

Figure 5:
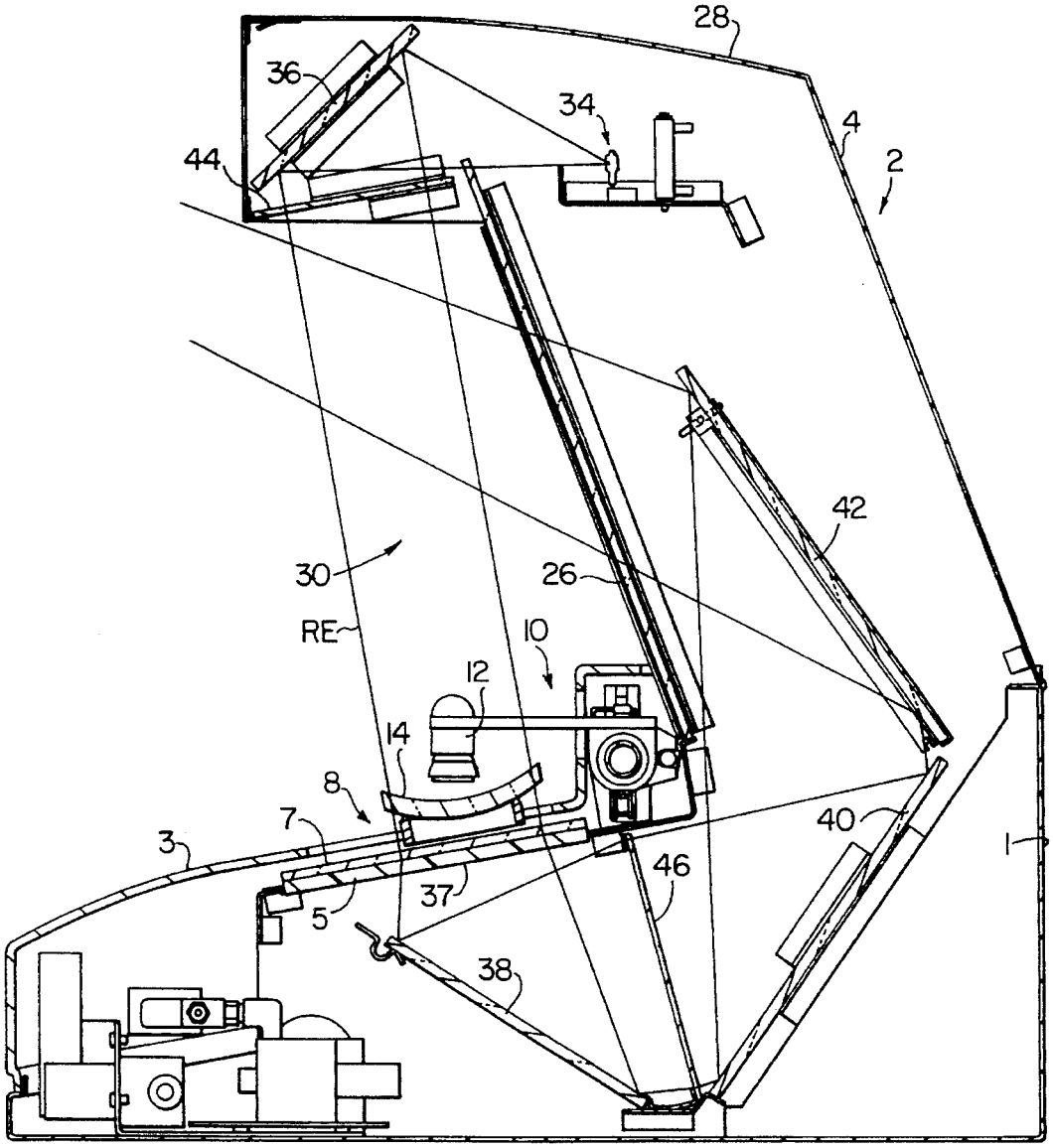
FIG. 5 is a vertical section view taken along line 5—5 in FIG. 2 showing the viewing tower.

Referring now to FIG. 5, and in particular to the details of optical tower 4, it should be seen that the optical tower is provided with a display screen 5, a tower frame 26 extending upwardly from and disposed internally within the base 1 and which upper frame portion being covered by a housing 28 partially enclosing the tower and defining a viewing port 30 opening to the front of the apparatus. The viewing port presents the image 6 shown in FIG. 1*a* to the user which is the combined affects of the superposition of the alignment support ring 8 and the graphic generated by the display screen 5 as together projected through a mirror and lens projection system housed within the optical tower 4. The projection system further includes a radiant energy source 34 in the preferred form of a halogen lamp disposed within the housing at the top of the optical tower, a first light redirecting mirror 36 disposed adjacent to the lamp 34 and oriented at an angle relative thereto such that light radiated from the lamp is redirected downwardly through a fresnel collimating lens 44 toward the display screen 5 supported on the apparatus base 1 below it. Disposed below the display screen 5 and the alignment support ring 8 is a diffusing surface 37 on which the projected image of the lens and display screen graphics are formed, and which surface is defined by a frosted MYLAR Film. A mirror 38 is oriented at an angle with respect to the downwardly directed light. A third light redirecting mirror 40 is provided at the back of the tower and is disposed generally adjacent the second mirror 38 for the purpose of reflecting the image cast onto it by the second mirror toward a viewing mirror 42. The viewing mirror is disposed generally at the back of the tower and is located adjacent the third light redirecting mirror 40 such that the image cast onto it is caused to reflect on the viewing mirror and be seen by the user through the viewing port 30. The superimposed image formed on the diffusing surface 37 is caused to pass through a second collimating freznel lens 46 disposed between the second and third light redirecting mirrors 38 and 40 prior to being projected on the viewing mirror 42. The lens 46 is an enlarging lens and is provided to enable easier viewing of the formed image.

The display screen 5 is a translucent liquid crystal display of the type commonly found in back-lit laptop computers and accordingly allows the collimated light RE directed downwardly from the first light redirecting mirror to pass through it and allow the displayed image to be projected along with the outline of the lens blank and various features onto the diffusing screen 37. The liquid crystal display is covered by a protecting glass plate 7 supported on the base 1 and may take many forms, but in the preferred embodiment it is 540×480 pixel VGA screen which is commercially available.

Figure 6A:
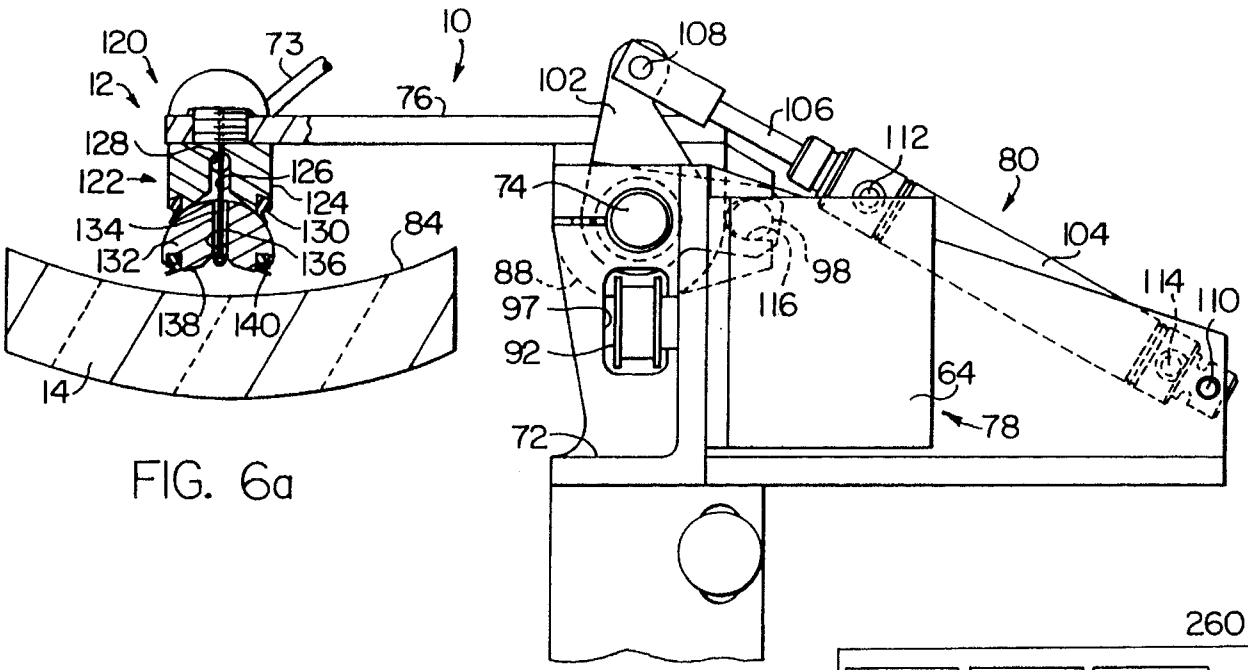
FIG. 6*a* is a partially fragmentary side elevation view showing the positioning device apart from the apparatus as a whole.
Figure 6B:
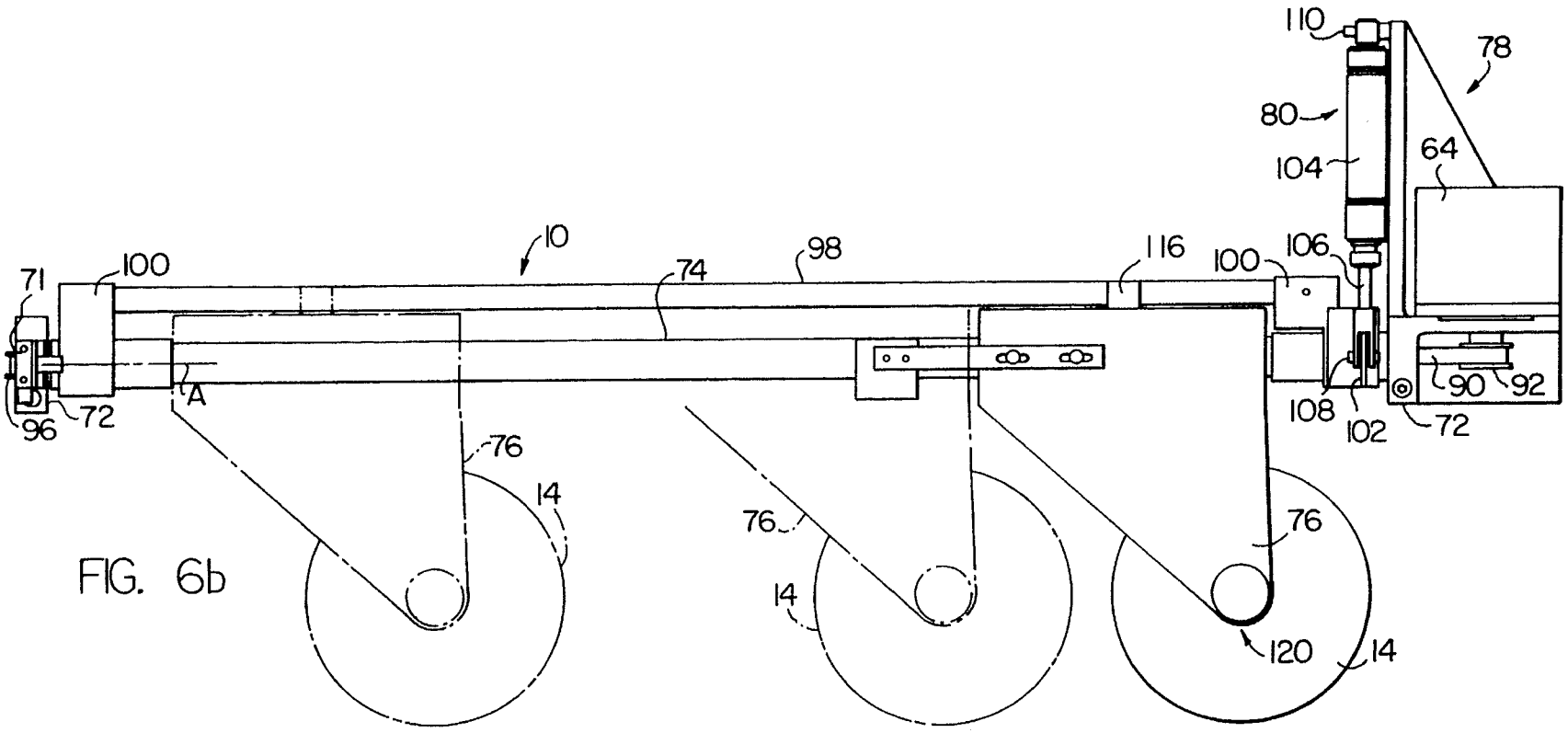
FIG. 6*b* is a detailed top plan view of the positioning device shown apart from the apparatus.
Figure 6C:
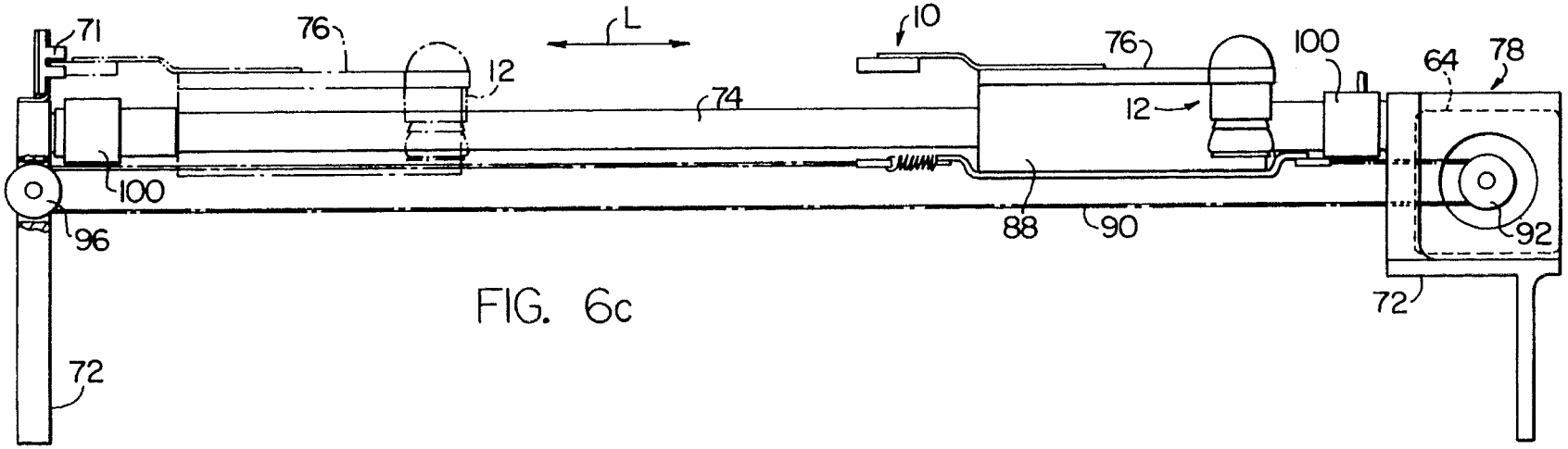
FIG. 6*c* is a front elevation view of the device shown in FIG. 6*b*.

Referring now to FIGS. 6*a*–6*c*, and in particular to the details of the pick and place means 10, it should be seen that this means includes two spaced vertically extending support posts 72,72 disposed on the base 1, a way 74 having a central axis A and secured against movement within the posts at its opposite ends, and a traveler arm 76 disposed for movement along the way and driven in the indicated L direction by a drive means 78 and pivotal about the axis A of the way 74 through the intermediary of a pivot actuator means 80. The traveler arm 76 is cantilevered outwardly of the way 74 and carries at its distal end 120 a vacuum operated holding means 82 adapted to engage the inner surface 84 of the lens blank 14. The traveler arm 76 includes a journalling part 88 disposed about the way 74 for both pivotal movement about the axis A and linear movement in the indicated L direction. To these ends, the journalling part 88 is connected at its underside to a belt 90 which is trained at one end about a drive pulley 92 associated with the stepper motor 64 and is trained at its opposite end about a return pulley 96 rotatably mounted to an associated one of the posts 72,72. An opening 97 is formed in the one of the support posts 72,72 located adjacent the drive motor 64 permitting the endless belt 90 to pass between the drive and return pulleys.

Pivotal movement of the traveler arm 76 is effected by the pivot actuator means 80 which includes a double acting actuator 104 and a drive bar 98 extending substantially parallel to the axis A of the way 74. The drive bar is held in spaced parallel relationship with the way by means of end blocks 100,100 each journalled about the way 74 and each secured to the drive bar 98 at its opposite distal ends. One of the end blocks 100,100 includes a lever 102 integrally connected with it and projecting radially outwardly of the axis A in a generally upwardly extending direction. The lever 102 is connected to the double acting actuator 104 such that the sliding actuator rod 106 is pivotally connected at its free end to the lever 102 of the juxtaposed one of the end blocks 100,100 at 108, while the opposite end of the actuator 104 is connected to the base at a second pivot location 110. Pressurized air lines are connected to the actuator through inlets 112 and 114 the introduction and ceasation of pressurized air through each of these inlets being respectively controlled by solenoid valves disposed in the rack 66. A generally U-shaped cutout 116 is formed in the back side face of the journalling part 88 and is sized to snugly receive the outer diameter of the drive bar 98. The traveler arm 76 through this connection is thus caused to pivot between a lowered position resulting from the actuator being energized and the rod 106 prompted to its extended position, and a raised position corresponding to the retraction of the rod 26 by the respective introduction of pressurized air into the inlets 114 and 112 at different times.

The traveler arm 76, as illustrated is cantilevered outwardly of the way 74 such that the holding means 82 carried by it is positioned for engagement with the opposed face 84 of the lens blank when the lens blank 14 is positioned in the alignment support ring 8. The holding means 82 includes for this purpose a ball and socket gripper 122 disposed at the distal end 120 of the traveler arm 76. The socket part 124 of the gripper is threadly attached to the arm 76 and includes a cavity 126 communicating with an inlet 128 disposed between the cavity and the outer surface of the socket. A vacuum source is provided (not shown) remotely of the arm 76 and communicates with the cavity 126 through a vacuum line 73 connected between the inlet 128 and the vacuum source, with one of the solenoid valves in the bank 66 operating at a point along this line to selectively controllably open and close the applied vacuum to the gripper 122. Disposed annularly about the downwardly facing opening defined by the cavity 126 is a rubber seal 130 which seats on the confronting spherical surface of the ball part 132. The spherical surface of the ball part is mechanically maintained in confrontation with the rubber seal 130 by an elastic elongate element 134 acting between the two mated parts. A passage 136 is formed in the ball part 132 and communicates between the outer spherical surface of this part and a flared opening 138 disposed at the lower end of the ball part. The elastic element 134 is secured at its top end to the socket part and is stretched through the passage 136 and secured against movement at its opposite lower end within the flared opening 138 of the ball part. It being noted that the securement of the lower end of the elastic element 134 within the flared opening 138 does not significantly restrict the introduction of vacuum through the opening.

Disposed about the base of the ball part 132 is a lip seal 140 which acts between the ball part 132 and the inner surface 84 of the lens blank 14 to form an air seal when the arm is lowered bringing the gripper and the lens blank into engagement and with vacuum being continuously applied. It is a feature of the invention to allow the gripper 122 to engage the surface 84 of the lens blank 14 with a prescribed amount of positional adaptability provided by the elongate flexible element 134 such that the ball part 132 may reorient itself relative to the socket part during seating of the bellows seal 140 to the surface 84 of the lens blank. Once such seating on the lens surface is effected, the vacuum communicating within the gripper 138 not only serves to hold the lens blank to the gripper but further serves to lock the orientation of the ball part relative to the socket part through the intermediary of the annular seal 130 acting on the top spherical surface of the ball part 132.

Figure 7:
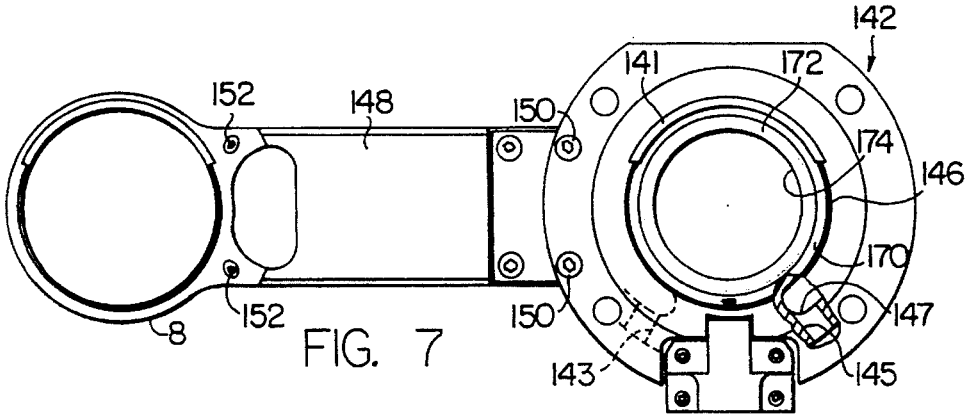
FIG. 7 is a top plan view of the alignment support ring as attached to the mounting block.
Figure 8:
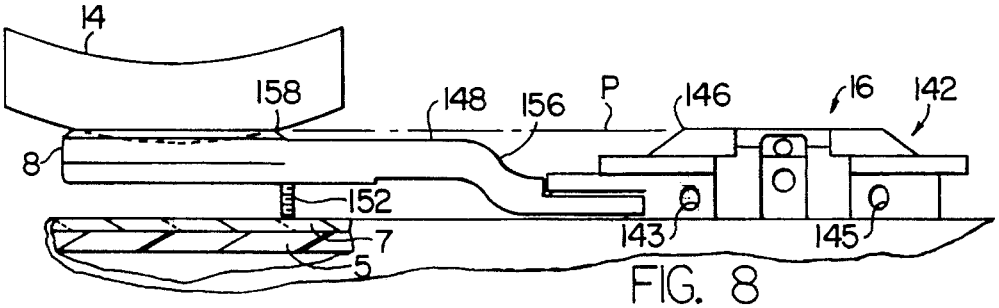
FIG. 8 is a side elevation view of the alignment support ring shown in FIG. 7.
Figure 11:
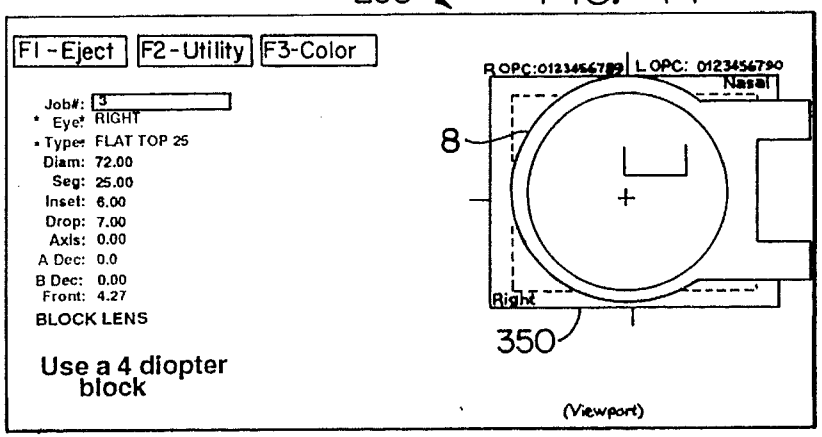
FIG. 11 illustrates the superposition of the support ring and provided target as superimposed on one another and as displayed in the viewing tower.
Figure 9:
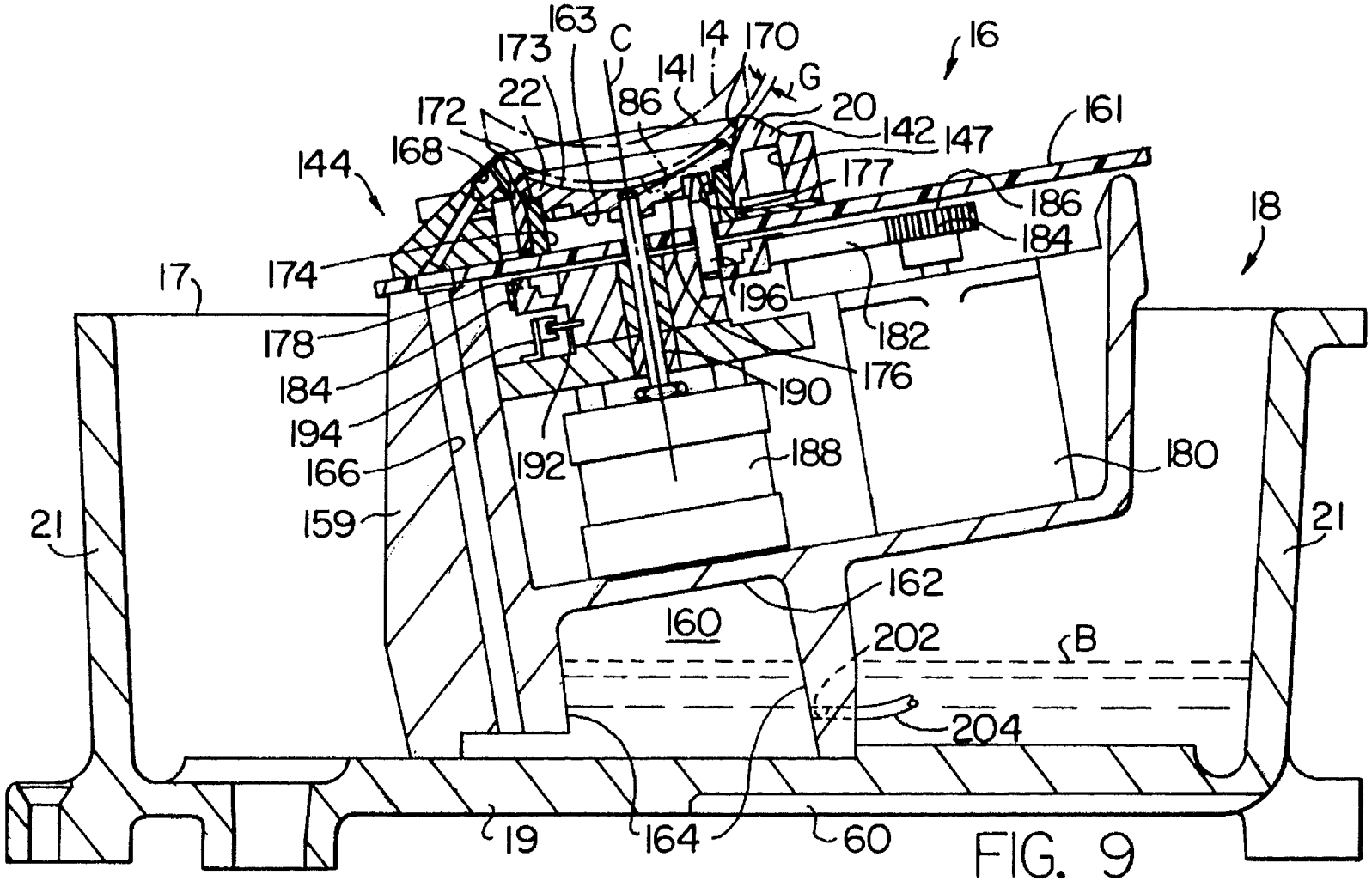
FIG. 9 is a partially fragmentary vertical section view showing the blocking station of the apparatus.

Referring now to FIGS. 7, 8, and 9, it should be seen that the blocking station 16 includes a blocking ring 142 secured relative to the base on a blocking stand 144 disposed within and supported by the base 19 of the reservoir means 17 for the purpose of receiving and supporting a block 176 situated below a lens blank to be bonded with the supported block. The alignment support ring 8 is fixedly connected to the blocking ring by a coupling bar 148 integrally connected with the ring support at one end and is secured against movement at its other opposite end to the blocking ring 142 by suitable attachment means, such as screws 150,150, or the like. The alignment support ring 8 is disposed above the display screen 5 and is maintained in registration with a location known on the screen by the securement of the coupling arm 148 to the blocking ring 142. The alignment ring is also maintained in a vertically stable position through the intermediary of two sets screws 152,152 which rest on the glass cover plate 7 fixed to the base above the display screen 5. The coupling arm 148 has a bend 156 located in it intermediate its length for the purpose of vertically situating the upwardly directed edge 158 of the alignment ring 146 in a plane P coincident with the correspondingly upwardly directed edge 146 provided in the blocking ring 142 and is aided in such registry by the support of the sets screws 152,152 acting on the glass plate 7. The alignment ring 8 is thus positioned over the display screen 5 such that a visually discernable target 350 is projected about ring 8 for lens blank alignment purposes as will hereinafter become apparent as is best illustrated in FIG. 11.

Figure 12A:
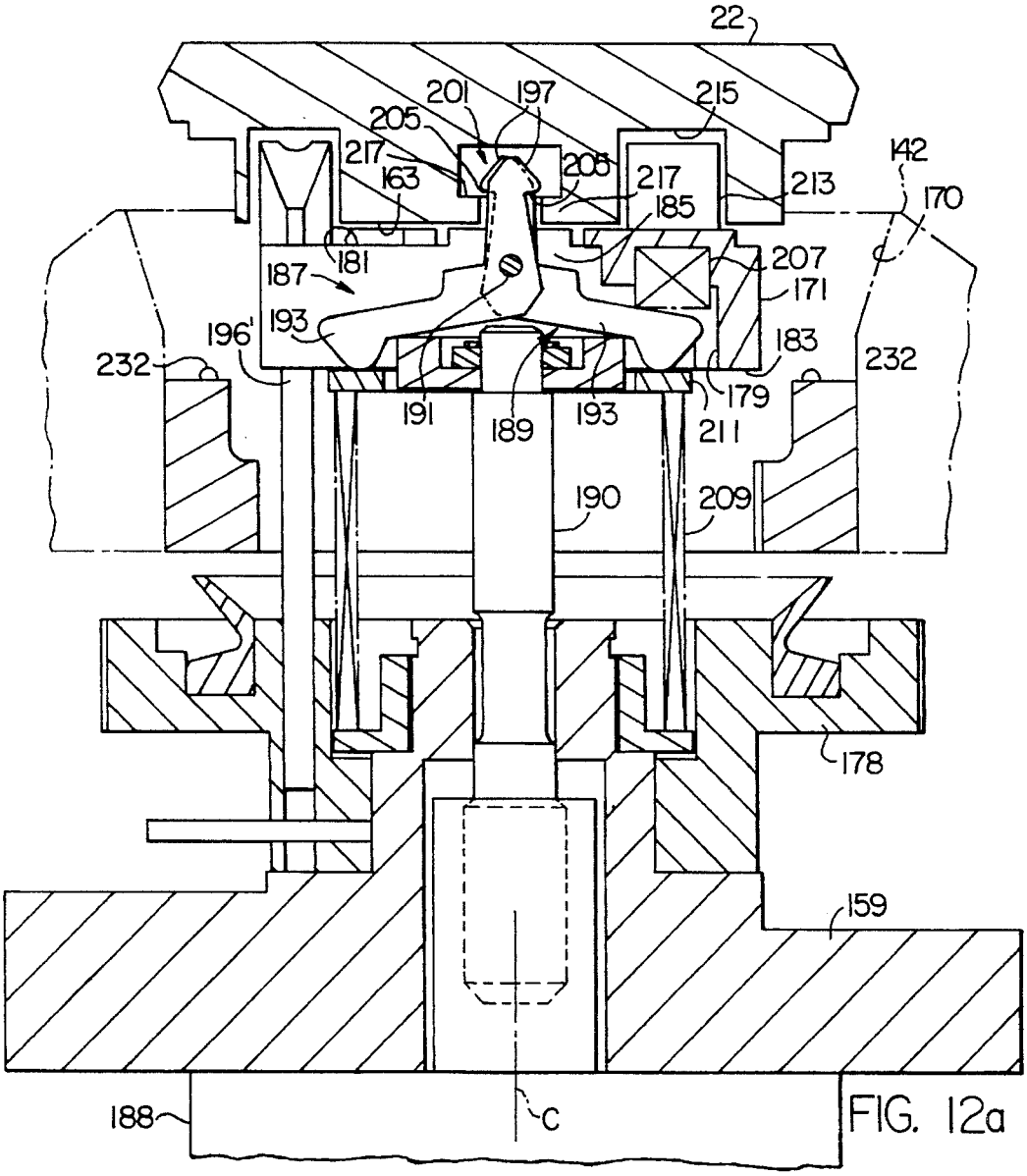
FIGS. 12*a* and 12*b* show a first embodiment of a block seating device.
Figure 12B:
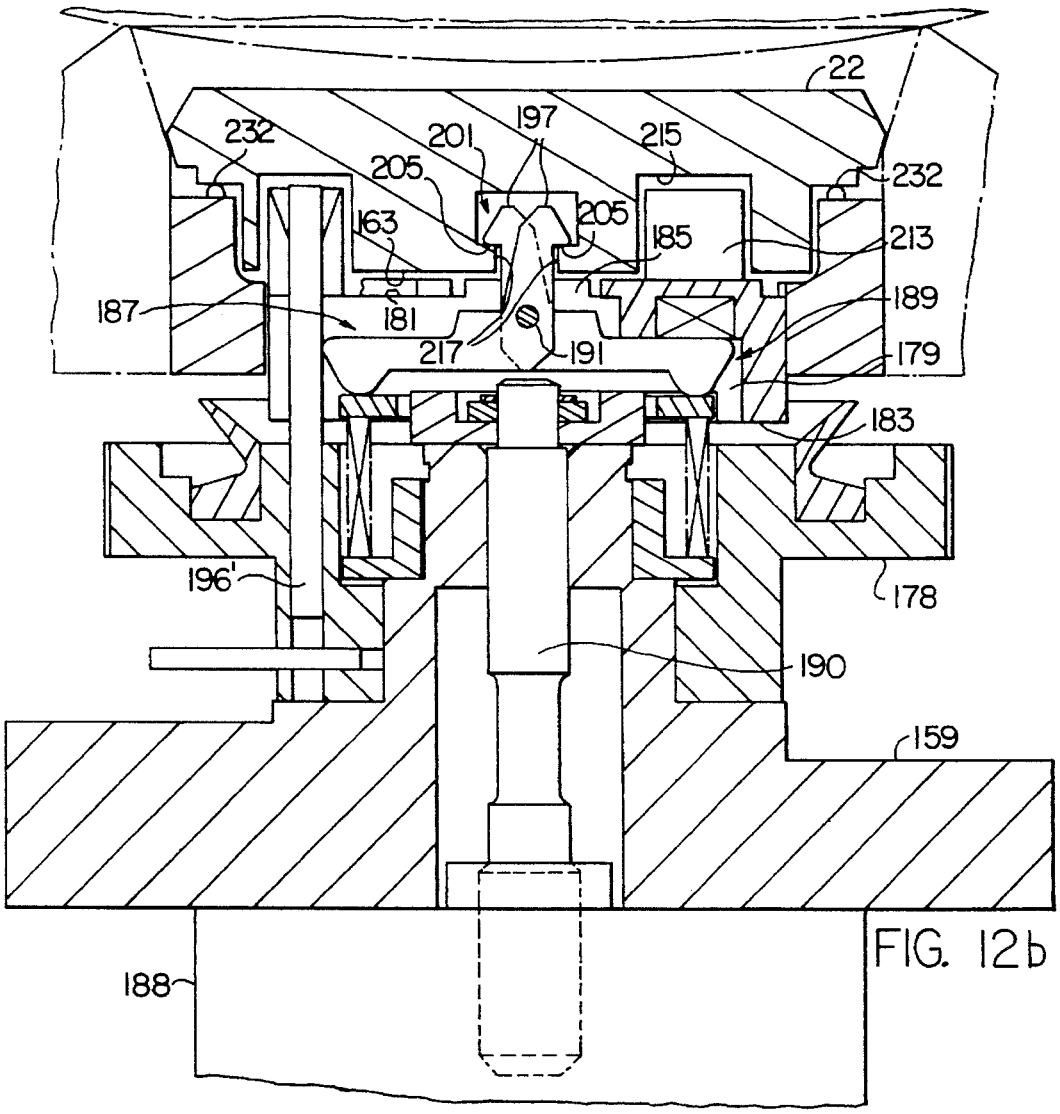

The blocking stand 144 is specifically adapted to simultaneously hold a lens blank and a block in spaced vertical relationship in order that a bonding material B be interposed therebetween. To these ends, the blocking stand 144 is defined by a frame 159 having a generally hollow interior portion or chamber 160 disposed at its bottom end separated from the remainder of the blocking stand by a containment wall 162 and sidewalls 164,164 disposed generally orthogonally to the containment wall. Interposed between the blocking ring 142 and the chamber 160 is a fluid passage 166 communicating between the chamber and the blocking ring for the purpose of delivering and introducing the liquified bonding material B into the interior confines of the blocking ring 142 through an inlet 168. The interior of the blocking ring is provided with a frustoconical surface portion 170 which creates a mold cavity for the liquid bonding material. This interior ends in a support shoulder 172 defining a shouldered opening 174 correspondingly sized and shaped to receive a correspondingly shouldered structure 167 formed on the rear face of the lens block 176 as best illustrated in FIGS. 12*a* and 12*b*. A rotatable part 178 is journalled to the frame 159 for rotation about the indicated rotational axis C oriented concentrically with the shouldered opening 174 and is controllably rotatably driven by a positioning step motor 180 having a drive sprocket 186 drivingly connected to the rotatable part 178 through the intermediary of a toothed belt 182 engaging drive teeth 184 disposed about the periphery of the rotatable part 178 and about the periphery of the drive sprocket 186.

Mounted within the frame 159 of the blocking stand 144 is an actuator 188 having a sliding rod 190 vertically moveable between an extended position corresponding to the position taken by the rod when a user initially places the block 176 onto the blocking ring 142 and a retracted position corresponding to the lens block being lowered into the shouldered opening 174 and seated against the shoulder 172. Provided on the rotatable part 178 is an indicator 192 which co-acts with a sensor 194 secured to the frame 159 and connected to the peripheral driver 56 of the control system to establish an angular origin from which the part 178 is controllably rotated by the motor 180. The rotatable part 178 also includes at least one vertically disposed locating pin 196 which has an appropriately sized end shaped to fit within a corresponding sized and shaped blind locating opening 177 formed in the back face 163 of the lens block 176 so as to cause the block to be rotated a given angular amount from its designated origin according to any off axis parameter prescribed by the lens prescription. A barrier plate 161 is mounted to the frame to protect the component parts of the motor drive from damage by bonding material, but this plate nevertheless includes a circular opening allowing the locating pin(s) to freely rotate about the axis C.

The bonding material B in the preferred embodiment is a low melting temperature thermoplastic which exists normally in solid form and is maintained in a liquified state within the reservoir means 17 by a plurality of electric heater elements 200,200 which line the base 19 of the reservoir and are controllably energized by the peripheral driver 56 to maintain the blocking material at a temperature of 115–160 degrees Fahrenheit depending on the bonding material selected. For this purpose, a sensor is located within the reservoir to monitor the temperature of the bonding material bath and is linked to the control system to insure the designated temperature of the bath is maintained. The process of bonding the lens blank to the block involves situating the lens blank in a vertically spaced relationship relative to the block while the two parts are mounted on the stand 144 to create a gap G therebetween and injecting the liquified bonding material B into this gap to effect bonding. This is accomplished by causing the liquified blocking material B to move upwardly through the fluid passage 166 from the chamber 160 and fill the gap G. To effect such movement of the blocking material B, a positive air pressure source (not shown) is provided and is introduced into the chamber 160 through an opening 202 disposed between the chamber and a pressurized air line 204. The introduction of pressurized air into the chamber 160 is controlled by one of the solenoid actuator valves in the bank 66 acting independently and in response to a given key being depressed by the user. As such, depending on the volume of pressurized air introduced into the chamber 160, a corresponding displaced volume of the liquified blocking material is caused to be moved upwardly through the passage 166. This volume may be varied by varying the air pressure in the chamber, for example, by pulse width modulating the signal responsible for opening and closing of the air pressure solenoid valve in order to effect these ends. This is important in that depending on the viscosity of the liquified bonding material B, the solenoid valve responsible for introducing pressurized air into the chamber 160, can effectively be fluttered to create a tamping effect in the gap G as the material is caused to harden. Formed along a portion of the edge of the blocking ring 142 is a shallow cutout 141 which permits the bonding material to bleed out of the blocking ring as during the injection process.

The blocking ring 142 as best depicted in FIG. 7, is a hollow internally toroidal member having an internal confine 147 communicating with an inlet 143 and an outlet 145 the inlets and outlets are connected to a refrigeration station (not shown) which provides a supply of chilled water to the interior confines 141 for the purpose of fast hardening otherwise liquified blocking material B.

Figure 10:
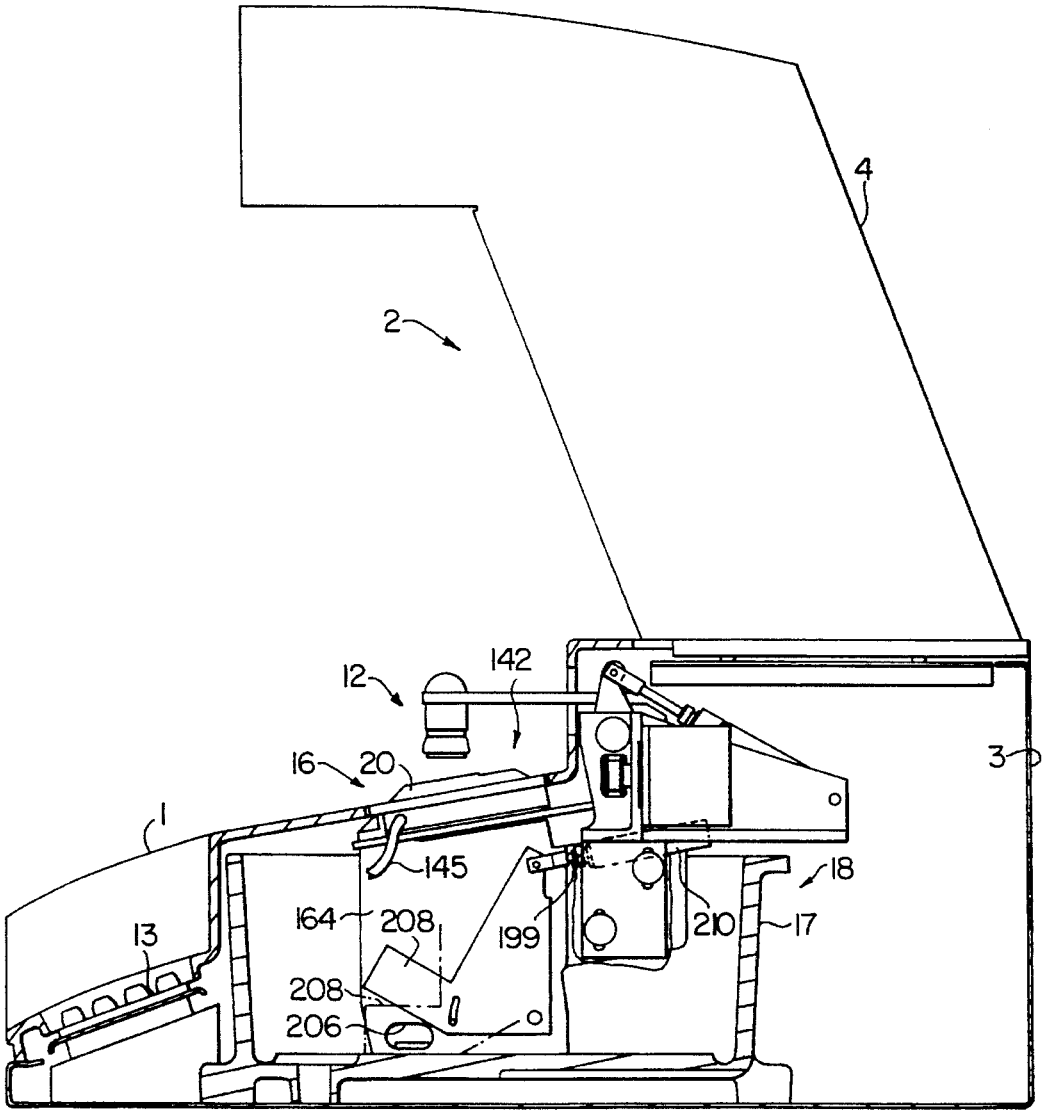
FIG. 10 is a vertical sectional view taken along line 9—9 in FIG. 2.

Referring now to FIG. 10, it should be seen that the liquified bonding material B in the bath contained in the reservoir means 17 flows freely between the reservoir and the chamber 160 of the blocking stand through an inlet 206 formed in one of the sidewalls 164,164 of the chamber 160. During periods when the lens blank is not being bonded to a block, the inlet 206 is normally open, but is closed-to-flow when blocking occurs. Closure and sealing of the inlet results in the chamber being effectively isolated so that it may be pressurized. This is done through the intermediary of a gate 208 which is pivotally mounted to an involved sidewall 164 such that it is operatively moveable between an opened position as indicated in the solid line wherein the inlet 206 is unrestricted against fluid passage and a closed position as indicated in phantom line corresponding to the condition where the inlet is closed to flow. To effect such pivotal movement of the gate 208, an actuator 210 is provided and is secured at one end to the base 1 of the apparatus and includes a sliding rod 211 moveable between extended and retracted positions corresponding respectively to the closed to flow and open to flow conditions of the inlet 206. The actuator 210 is connected to a pressurized air source, the on and off conditions of pressurized lines to the actuator, being controlled by one of the solenoid valves in the bank 66.

It is highly important to the blocking process to insure that the lens block is flushly seated in the blind opening before the blocking material B is injected. To these ends, a means is provided as part of the blocking stand 144 to ensure proper seating of the block during the bonding process. As illustrated in FIGS. 12*a* and 12*b*, the preferred means for this purpose includes providing a placement disc 171 disposed coaxially above the rotating part 178 and rotatably connected to the rotatable part 178 through the intermediary of the locating pin 196. The disc has an upper face 181 and a opposite lower face 183 and is secured against movement to the distal end of the vertically moveable rod 190 so as to be controllably moveably positionable between a raised position as illustrated in FIG. 12*a* corresponding the position assumed by the disc when a block is to be mounted on it and a lowered position as illustrated in FIG. 12*b* corresponding to the position assumed by the block during bonding of the block to a given lens blank. The placement disc 171 includes a diametric cut 179 opening to the bottom face 181 and a central slot 185 communicating with the cutout 179 and located in line with the central rotational axis C of the rotating part 178. Received within the internal cutout 179 are a pair of gripping arms 187,189 which are pivotally connected to the placement disc 171 in a scissors-like fashion through the intermediary of a pivot pin 191. Each of the gripper arms has a generally L-shaped configuration defined by a lower lever portion 193 extending orthogonally to the central axis C and gripping portion 197 extending generally coincidentally with the central axis C. Each of the gripping portions 197,197 is complimentary shaped when caused to be moved in a side-by-side orientation so as to create a generally arrow-like projection 201 which is symmetric about the axis C. Further, each of the gripping portions 197,197 includes an underflange 205 which extends generally orthogonally to the central axis C for the purpose of engaging behind a mounting flange 209,209 formed in the back face of the block.

Disposed within the placement disc 171 area first biasing means 207,207 which act between the top surfaces of the lever portions 193,193 of the arms and the internal surface of the cutout 179 to maintain the arrow-like configuration of the gripper portions 197,197. Disposed below the placement disc 171 is a second biasing means 209 which in the preferred embodiment takes the form of a helical spring disposed concentrically about the sliding rod 190 and the central axis C. The second biasing means 209 acts against an annular ring 211 positioned between it and the lower end faces of the level arm portions 193,193 to otherwise bias the gripper portions 197,197 apart from one another in the indicated condition as shown in FIG. 12*b* and to cause locking to occur between the upper surface 181 of the disc and the block.

The relative forces of the first and second biassing means are selected such that with the upward movement of the sliding rod 190, the force generated by the first biasing means 207 will exceed that imposed by the second biasing means 209 such that the arms 189 and 190 will be moved under the bias of the first biasing means so as to move the gripper portions 197,197 to a closed position to assume the arrow-like shape. Alternatively, as the sliding rod 190 is moved to a lowered or retracted position as illustrated in FIG. 12*b*, the force generated by the second biasing means is such that it exceeds that applied by the first biasing means so as to cause the gripper arm portions 197,197 of the arms 189,187 to be moved apart. The travel of the rod 190 has some lost motion such that the block is not only positively gripped by the disc, but is also caused to be positively held down under the force of the actuator 188. Seating is enhanced by the use of three equidistantly spaced support pins 232,232 mounted to the frame 159. Also, to better assist the user in the correctly mounting the block to the placement disc, a second locating pin 213 is provided and is given an elongate cross-sectional shape relative to that of pin 196 and fits within a correspondingly shaped hole 215 formed in the back face 163 of the block 176. This arrangement insures single orientation fitting of the block on the disc.

Figure 12C:
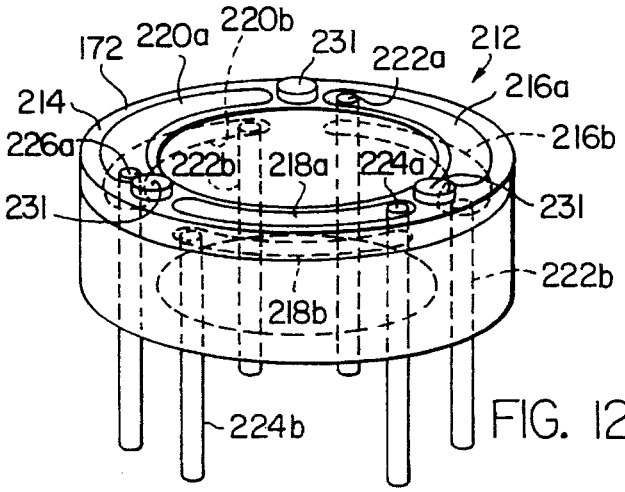
FIGS. 12*c* and 12*d* show the block seating board connections in a second embodiment of a blocking station.

Referring to FIGS. 12*c*,12*d* and 13*a*,13*b*, a second embodiment of a means for insuring proper seating of the block on the support shoulder 172 is illustrated. To these ends, the shoulder 172 as best illustrated in FIG. 12*c* is defined by a substantially annular seating means 212 located within the blocking ring 142. The seating means includes a generally toroidal printed circuit board 214 plated on opposite sides thereof with three arcuate segment sets 216*a,b*, 218*a,b*, 220*a,b* each respectively occupying a 120 degree portion of the circuit board 214. For purposes of this discussion, the arcuate segments occupying the top face of the circuit board will be designated under the "a[ label while those occupying the underlying face of the circuit board will be designated under the "b" label. These arcuate segments are connected to appropriate control circuitry for the purpose of detecting a seating condition whereby the lens block 176 is not flushly seated on the shoulder 172. This is important because any deviation from an otherwise flushly seated lens block prior to the blocking operation commencing, will result in unwanted prism and incorrect thickness being machined into the lens surface once the lens blank and block assembly is placed into an automated cutting machine, such as the one disclosed in the aforesaid U.S. Pat. No. 4,989,316.

Figure 12D:
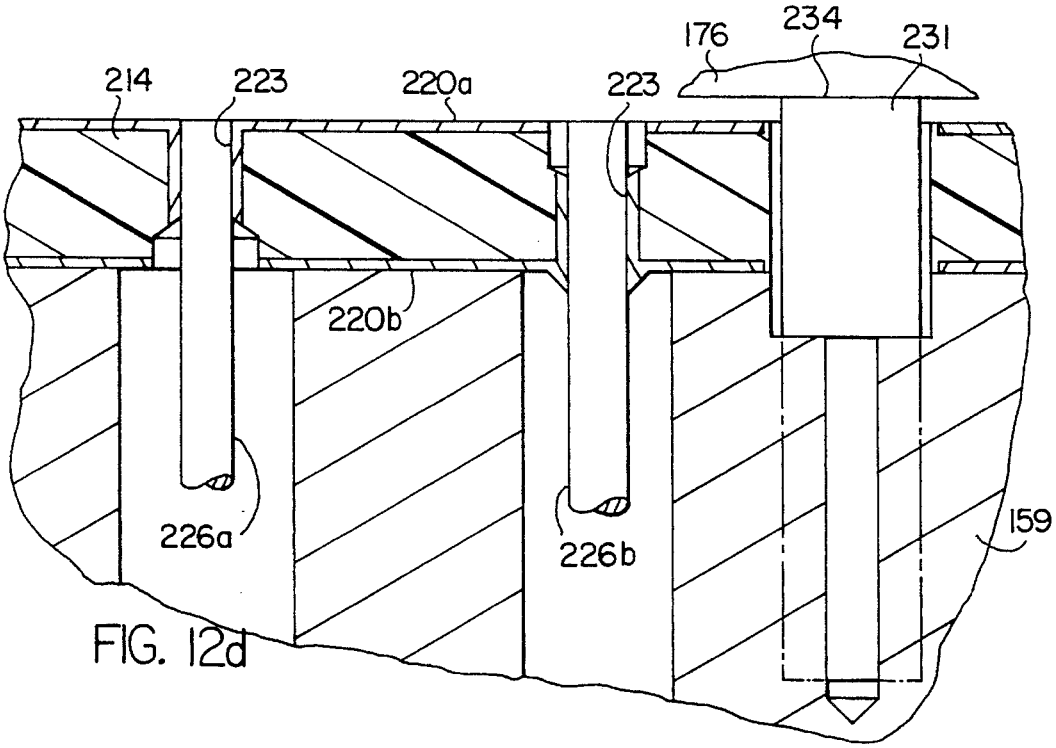

As illustrated in FIG. 12*d*, leads 222*a,b*, 224*a,b* and 226*a,b* are provided and respectively connect to corresponding ones of each of the upper and lower arcuate segments 214*a,b*, 216*a,b* and 218*a,b*. The leads 222*a,b*, 224*a,b*, and 226*a,b* connect through the printed circuit board 214 within openings 223,223 which are partially plated continuously with the arcuate segment to which the respective lead is attached. The seating means 212 further includes the three equidistantly spaced pins 232,232 which are disposed about the circuit board 214 each having a top surface 234 disposed slightly above the upper surface of the upper arcuate segments by about 5 thousands of an inch and each having a lower portion anchored to the frame 159 in a dielectric support material, such as one made from a phenol base. The top surfaces 234,234 of each of the pins 232,232 engage and support the lens block when it is placed within the shouldered opening 174 of the blocking ring 142 and thus support the base of the block slightly above each of the upper arcuate segments.

Figure 13A:
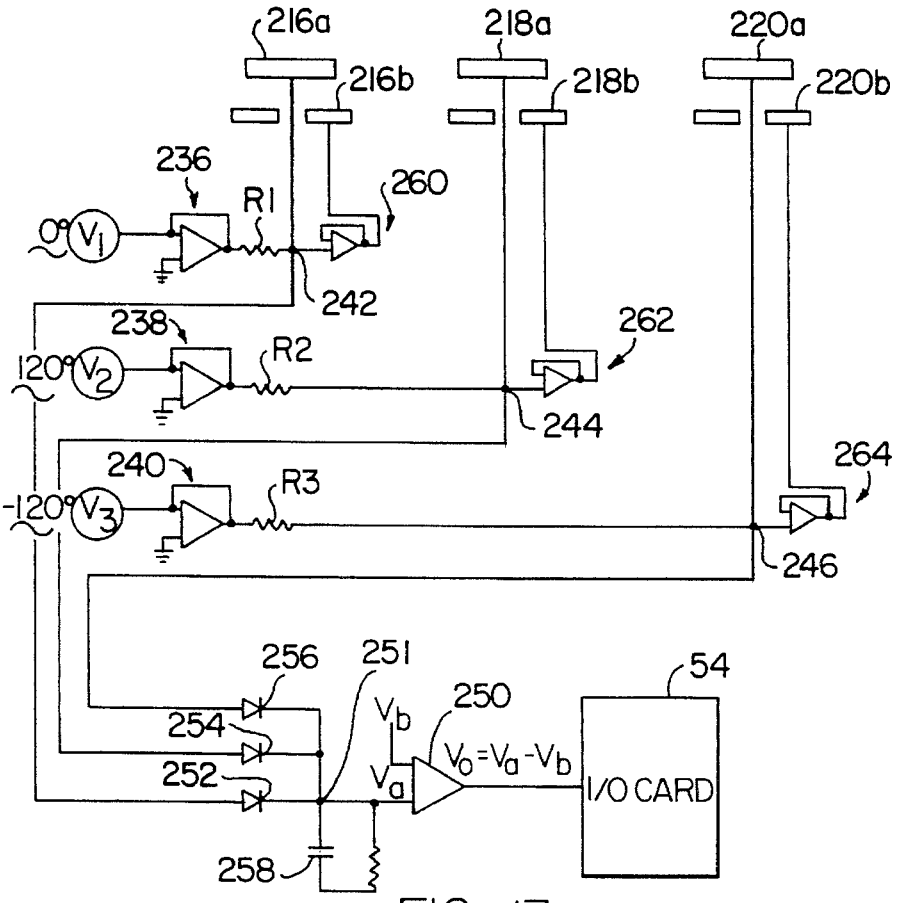
FIG. 13*a* is a schematic diagram of the block seating sensor circuit.
Figure 13B:
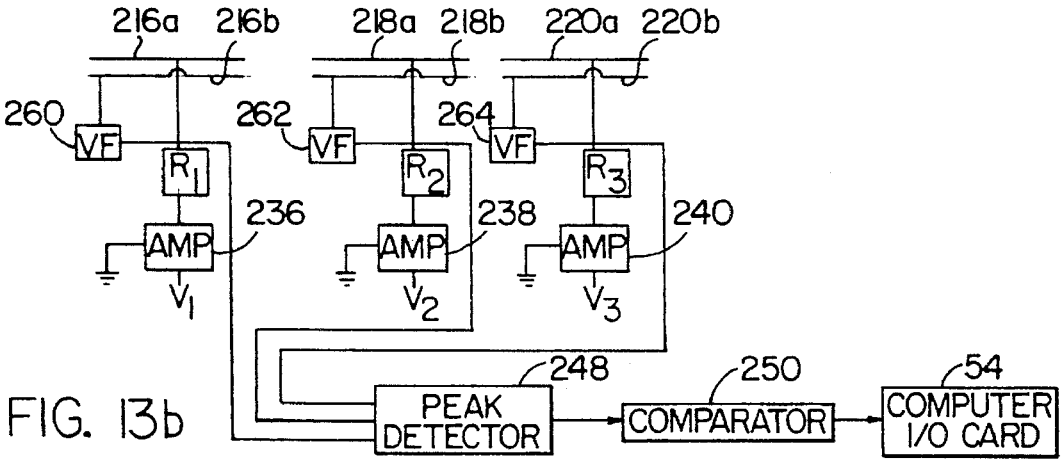
FIG. 13*b* is a schematic diagram showing in more detail the circuitry of FIG. 13*a*.

Referring now to FIGS. 13*a* and 13*b*, and in particular to the circuit which carries out the determination of proper seating for the lens block 176, it should be seen that each of the upper arcuate segments 216*a*, 218*a* and 220*a* are effectively separate capacitors whose capacitance is determined by the distance the bottom surface 175 of the block is located relative to them. By monitoring the capacitance of each upper segment, a determination can be made as to whether the position of the bottom surface 175 of the block is flushly seated within the shouldered opening 174 of the blocking ring 142. The upper arcuate segments 216*a*, 218*a* and 220*a* are each respectively separately connected to individual voltage sources $V_1$, $V_2$, $V_3$ which are passed through respective amplifiers 236, 238 and 240 and then through associated resistors R1, R2, and R3 to apply a known voltage to each of the upper arcuate segments of about 20 volts. The voltage sources $V_1$, $V_2$, $V_3$ are generated by a power supply circuit (not shown) which supplies alternating current at phases 120 degrees apart from one another to the input lead of each of the amplifiers 236, 238 and 240. The three phase arrangement of the power supply is intended so that the net voltage between the arcuate segments at any given point in time is equal to zero. Junctions 242, 244 and 246 connect the leads of each arcuate segment 216*a*, 218*a* and 220*a* to a peak detector 248. The output of the peak detector is connected to a comparator 250, the resultant logic of which comparator is input to the central processor 24 at the input/output subcontroller 54. The peak detector is comprised of three diodes 252, 254 and 256 with the input end of each of each diode respectively connected through lines to each of the junctions 242, 244 and 246 and having the output line of each diode connected in parallel with one another at junction 251. Thus, the highest inputted voltage passing through each of the three diodes of the peak detector, reverse biases the remaining two diodes and causes the highest voltage passing through the open diode to be the input voltage to the comparator 250. To stabilize the output voltage signal from the open diode, a capacitance circuit 258 is provided at the junction 251.

A reference voltage $V_B$ is applied to the comparator 250, and against this reference voltage, the voltage $V_A$ taken from the open diode is compared such that a resultant voltage $V_0$ equalling the difference between $V_A$ and $V_B$ is calculated. A LOGIC 1 condition is generated, if, for example, $V_A$ is greater than or equal to $V_B$, thereby making $V_0$ greater than or equal to 0, and a LOGIC 0 condition being generated if $V_A$ is less than $V_B$, thereby making $V_0$ a negative number. Thus, the largest existent distance between the bottom face 175 of the block and each upper arcuate segment 216*a*, 218*a* and 220*a* is determinable by measuring voltages at junctures 242, 244 and 246 and comparing the highest determined voltage to a reference voltage which corresponds to a maximum allowable distance. This is made possible through the capacitance of the associated arcuate segments being ultimately controlled by the proximity of the metallic undersurface 175 of the lens block 176 since capacitance is inversely proportional to distance.

The lower arcuate segments 216*b*, 218*b* and 220*b* are provided for the purpose of eliminating voltage potentials on the lower surfaces of the upper arcuate segments 216*a*, 218*a* and 220*a*, leaving the sole capacitance in the circuit to be between the between top surfaces of the upper arcuate segments and the under surface 175 of the lens block 176. For this purpose, voltage follower means 260, 262 and 264 are provided and each has its input line connected respectively to the junctions 242, 244 and 246, with each output line being connected respectively to associated ones of the leads 222*b*, 224*b* and 226*b* of the lower arcuate segments 216*b*, 218*b* and 220*b*.

Each of the voltage follower means as best illustrated in FIG. 13*b* is an operational amplifier having an input voltage taken at respective ones of the junctions 242, 244 and 246 such that the output of each of the amplifiers follows the voltage applied at each of the upper arcuate segments 216*a*, 218*a* and 220*a* thereby balancing the voltages on the opposed faces of the upper and lower arcuate segments.

In summary, it is important that the block be properly seated prior to injecting the blocking adhesive. Improper seating will result in unwanted prism and/or the wrong lens thickness. In order to ensure proper seating of the block, a special sensor is employed. The sensor operates by detecting the capacitance between three capacitor sensing plates and the block. The capacitor plates are driven by a symmetrical three phase sinusoidal signal source through separate series resistors. A three phase capacitive coupling to the block tends to make the block voltage zero with respect to ground (the block is at virtual ground) because the vector sum of a symmetrical three phase signal is zero. Capacitance, which is inversely proportional to distance, is detected by measuring the peak voltage at each capacitor plate. When the block is seated properly, the capacitance is maximum, and the peak voltage is minimum. All three plate voltages are connected to a common peak detector through separate diodes. Thus, the peak detector output follows the highest input voltage. In other words, the block must be seated close to all three plates for the detector to have a minimum acceptable output. A comparator signals the controller when the detector output is low enough. The plate capacitance may be small compared to other stray capacitance. In order to minimize the undesirable effects on the stray capacitance, standard guard techniques are employed.

Figure 14A:
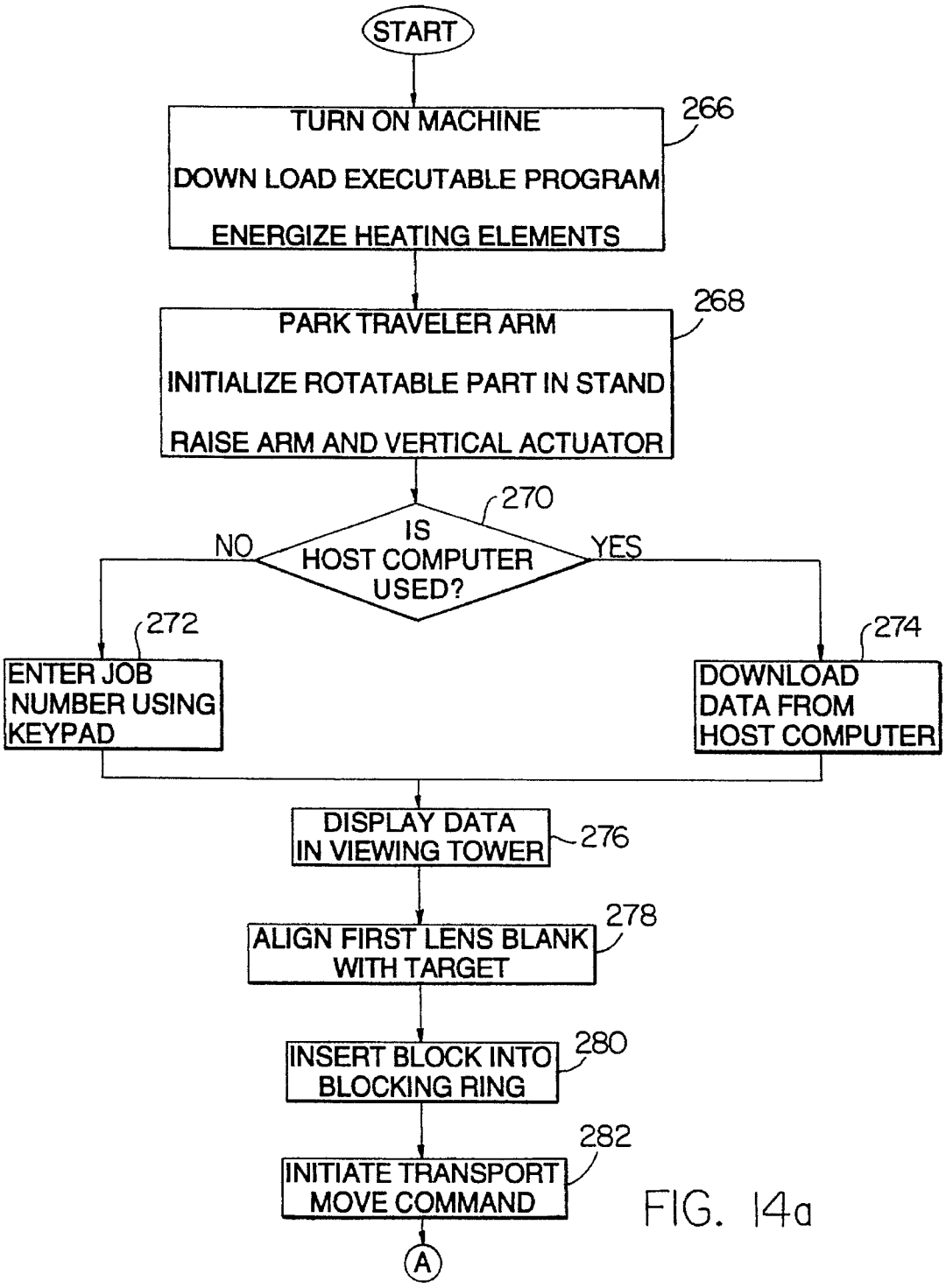
FIGS. 14*a* and 14*b* illustrate a flowchart of the general operation of the apparatus.
Figure 14B:
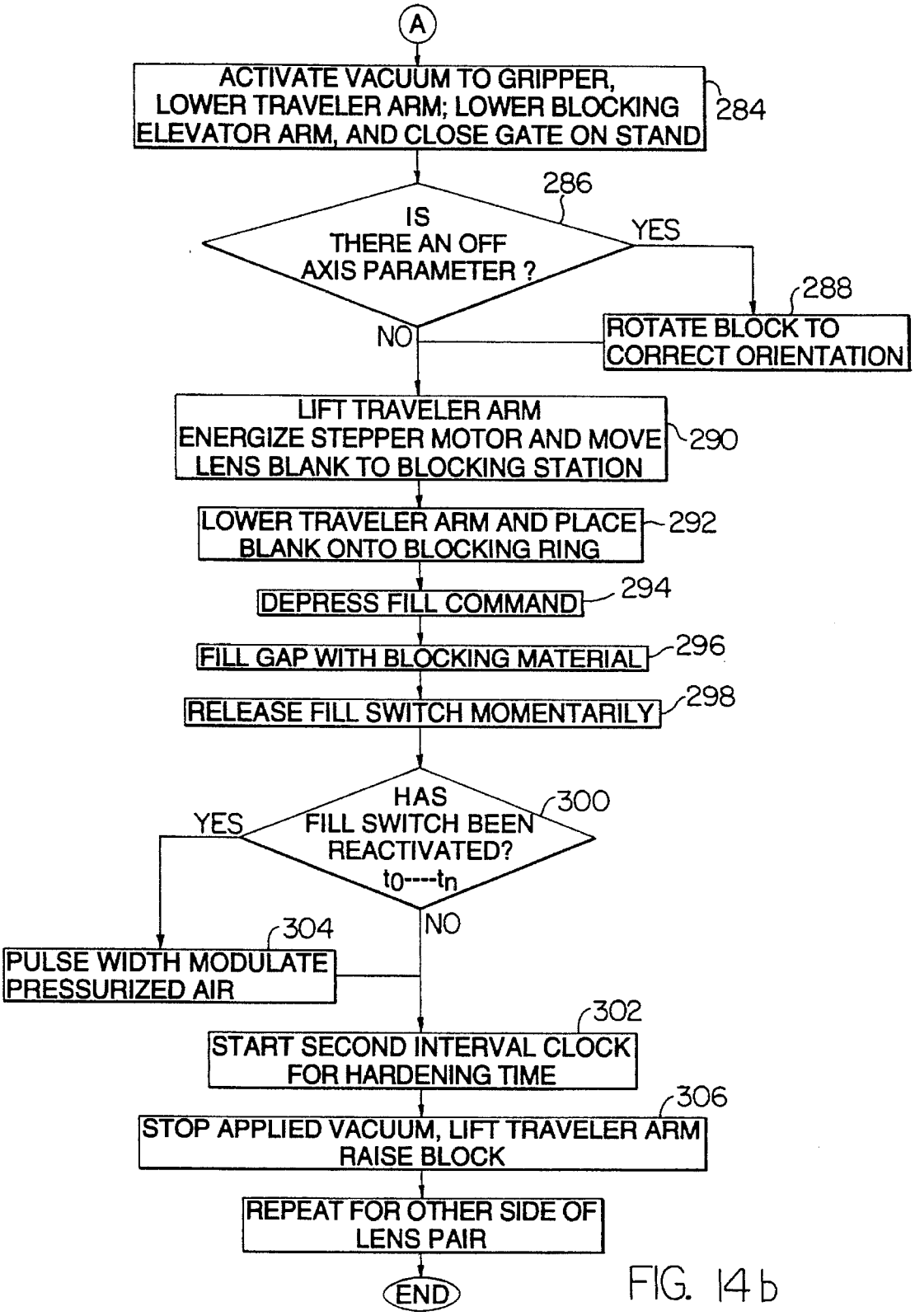

Operation of the complete system is illustrated by the flowchart of FIGS. 14*a* and 14*b*. The process is started by switching on the machine at the appropriate power ON switch (Step 266) which causes the downloading of the EXECUTABLE program into RAM and the heating elements 200 in the reservoir 18 to be energized and the blocking material B to take a liquid form. When the apparatus is powered up, the pick and place device 10 is initialized by raising the traveler arm 76 and moving it past a sensor 71 fixed to the base and thereafter moving the arm a predetermined distance from the sensor to a park location as illustrated in FIG. 6*b* in dotted line to keep the arm to keep clear of both the alignment and blocking rings 8 and 142 during the alignment process. Along with the initialization of the pick and place means is the simultaneous initialization of the locating pin 196 of the rotatable part in the blocking stand. (Step 268) Job description information is then accounted for by either manual entry of the job number through the keypad 13 (Step 272), or (Step 270) by on-demand downloading of data from a host computer through serial port 50 by entering a known JOB NUMBER through the Keypad or by using a bar code scanner (Step 272). The specific parameters of the job intended to be worked on are next caused to be displayed by the user depressing the ENTER key. (Step 276) As needed, the user may use the projected data to select the specifically called for lens type from a list of differing lens types. As will be discussed in greater detail with reference to FIGS. 15*a* and 15*b*, the graphic display options provided thereafter in the EXECUTABLE program are, for the most part, driven by the lens type that is called for by the prescription information. For the moment, it is only necessary to understand that the graphic display, in addition to displaying the called for parameters of a given job, also generates a full scale target 350 as depicted in FIG. 11, used to effect correct alignment of the lens blank relative to the ring 8.

Once a desired job with its associated data and target are displayed in the viewing port 30 in a manner best seen in FIG. 1*a*, the operator thereafter places the lens blank 14 on the alignment ring 8 and causes the edges or multifocal features of the blank to be positioned within the projected target thereby referencing the lens blank to a given prescribed orientation ultimately taken relative to the lens block to which it will be bonded. (Step 278) It is noted that the EXECUTABLE program for any given job calls up data on the right lens first, followed in turn by the respective data for the left lens of a given job.

The lens block 176 is also aligned relative to the locating pin(s) and positioned within the blocking ring 142 of the blocking station 16 such that the alignment opening 177 formed on the surface 175 receives the locating pin 198. To aid in achieving such alignment, a notch or other indicator may be formed on the block which aligns with a corresponding orientation marking made on the blocking stand 144. (Step 280) The user then prompts the machine by pressing the appropriate key on the keypad 13 to initiate the transport of the aligned lens blank to the blocking station 16 for placement on the blocking ring 142 in the precise orientation relative to the base that it maintained on the alignment ring 146. (Step 282) In response to the user prompting the MOVE command, the transport arm 76 is moved from its park position to the X1 position over the alignment ring 8, vacuum is applied to the gripper 82 and pressurized air is introduced through the appropriate chamber of the pivot actuator 80 to cause the traveler arm 76 to rotate downward into engagement with the upwardly facing surface 84 of the lens blank 14. Also, the normally up condition of the sliding rod 188 of the blocking station vertical actuator 190 is caused to move to its lowered position while at the same time, the pivotal gate 208 is moved to its closed to flow position. (Step 284) It is noted that in the case where a sensor type seating device is used, such as discussed with reference to FIGS. 12*c* and 12*d*, any improper seating signal must be remedied first before the blocking process is allowed to continue. Also, if there is an off-axis parameter for the prescription of the specified lens (Step 286), the block is rotated by the stepper motor 180 acting through the rotatable part 178 to precisely rotate the block in the prescribed angular orientation relative to the blocking ring 142 which surrounds it. (Step 288)

The traveler arm 76 is caused to be raised by the energization of the appropriate chamber of the actuator and shortly thereafter the traveler arm stepper motor 64 is caused to rotate a given number steps to thereby linearly move the gripper 122 from the X1 location adjacent the blocking ring 142 to the X2 location over the blocking ring 142. (Step 290) Thereafter, the appropriate expansion chamber of the actuator 80 is caused to be energized to thereby lower the traveler arm to place the lens blank squarely on the blocking ring 142. (Step 292) With the traveler arm lowered and effectively clamping the lens blank to the blocking ring 142, the user again prompts the controller by depressing a FILL command key (Step 294).

Once the operator presses the FILL keypad button, pressurized air is introduced through the line 204 by the controlled energization of one of the solenoid valves in the bank 66 thereby causing the liquified bonding material to fill the gap G between the lens blank and its corresponding block. The user continues to cause the flow of liquified blocking material into the gap by holding the FILL command key down until such time as the bonding material fills the void between the lens and the block, whereupon he or she releases the FILL key (Step 298). If the FILL key is not pressed again within a given interval, for example, five seconds (Step 300), then the controller begins counting through a second interval to allow for hardening of the bonding material B, which second interval is approximately 20 seconds depending on the characteristics of the bonding material B. (Step 302)

The solenoid valve controlling the introduction of pressurized air through the line 204 is pulse width modulated by the central controller during the second interval (Step 304) thereby maintaining a reduced pressure in the inlet 148 during the hardening process. This prevents the backflow of liquified bonding material through the fluid passage 166 during the hardening process and thus prevents the formation any undesirable void.

After a time period allowing for filling and hardening, the applied vacuum to the gripper 118 is stopped and the appropriate chamber of the pivot actuator 80 is energized thereby raising the arm away from the lens blank and the actuator 188 is energized to lift the now bonded lens blank with the block out the blocking station 16. (Step 306) During the hardening period as provided for in Step 302, the program allows for the alignment phase of the next lens to be conducted by presenting the target for the left lens, for example, in a two lens job to be presented on the display screen for alignment by the user such that once the hardening process is complete the transport process on the now aligned following lens can be effected.

Figure 15:
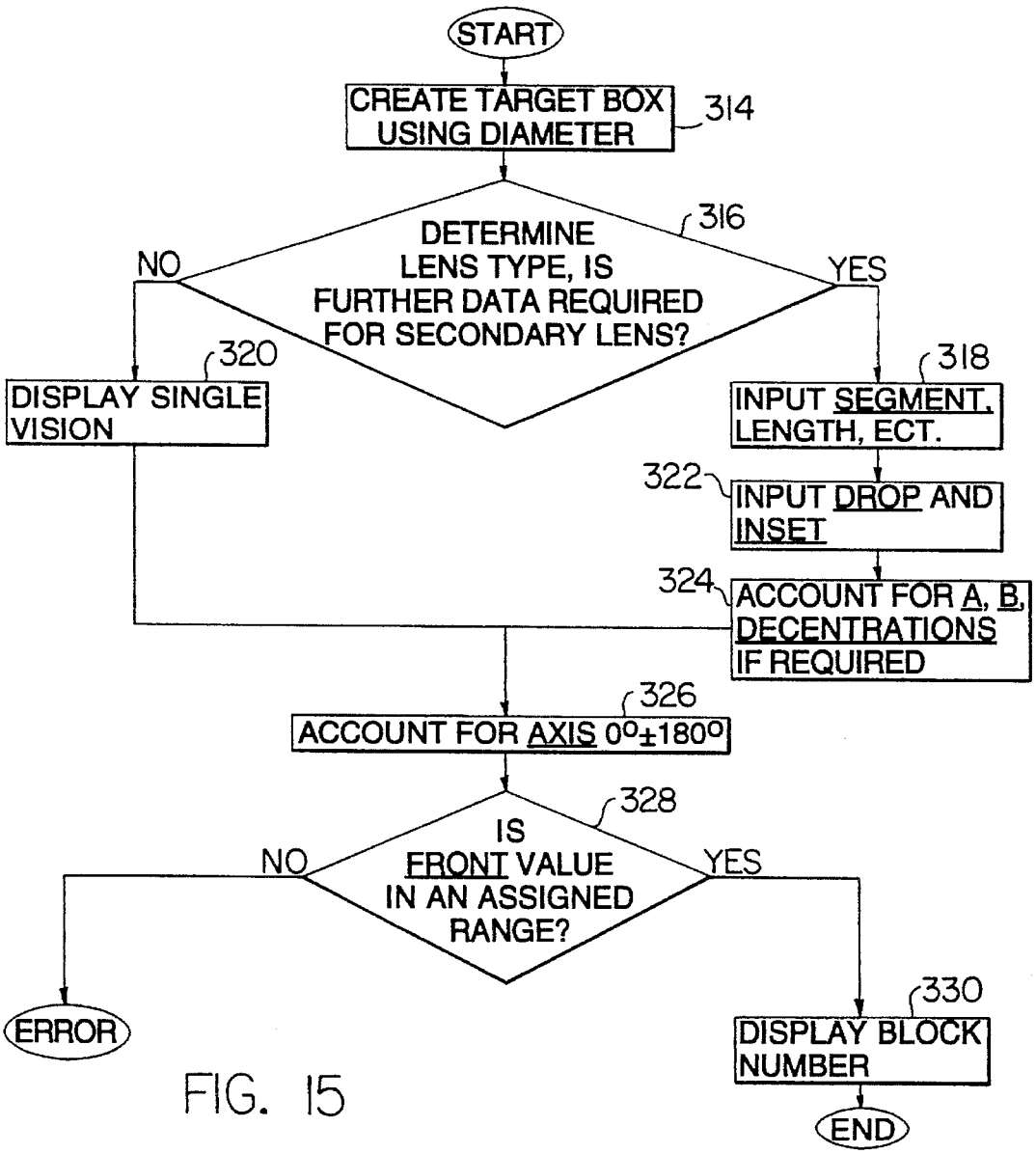
FIG. 15 is a detailed flowchart illustrating the operations of the computer generated graphic template feature of the invention.

Referring now to FIG. 15, and in particular to the program responsible for displaying the projected graphic target and related data on the display screen 5, it should be seen that the program is essentially driven by data input to it either initially by a host computer entered through the keyboard by a user. It should be noted that in either case the user may, despite whatever data exists in the file of the central controller 24, subject this data to editing by using the keypad 13.

Data corresponding to the specific prescription called for is assigned to each lens blank to be blocked. This data is displayed on the screen 5 and includes the following list of parameters arranged on the screen as best illustrated in FIG. 11:

(1) JOB NUMBER:
(2) EYE:
(3) TYPE:
(4) DIAMETER:
(5) SEGMENT:
(6) INSET:
(7) DROP
(8) AXIS:
(9) A DECENTRATION:
(10) B DECENTRATION:
(11) FRONT:
(12) BLOCK TYPE

The data input for each of the parameters (1)–(11) above, will affect the type, size and the presentation of the target 350 which is ultimately presented on the screen. The target 350 is created using commercially available graphics routines which create the box-like target using the input parameters for the job to be blocked, which in the case of the target box 350 is the DIAMETER parameter. It is noted that two boxes are displayed, the solid outer box is the true blank diameter with a inner slightly smaller dashed-line box defining a backup diameter for irregularities in the edge blank which may cause difficulties in the alignment using only the solid line outer box. Using a combination of sides from either of the dashed or solid lined boxes will qualify the lens for proper seating within the given target area. (Step 314)

The SEGMENT parameter corresponds to the width of the secondary focal lens, if any is required by the prescription. Before any segment calculation can be made however, the program must first determine whether the lens is of one of the types referenced in the program, namely, flat-top, round segment, progressive, aspheric or special lens. (Step 316) If the lens is one in which a secondary or third lens is involved, then a required value for the SEGMENT width parameter must be entered. (Step 318) If the lens is not one of these types, then the program assumes the involved lens is a single vision lens (Step 320) and accounts for the next parameter.

Figure 16:
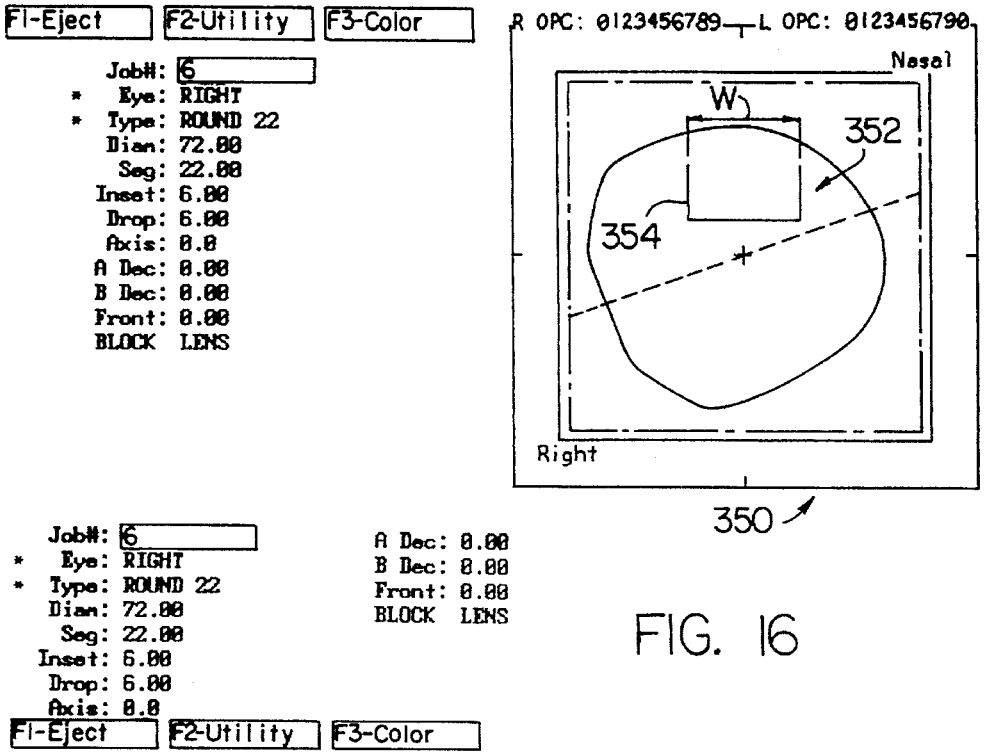
FIG. 16 illustrates a projected target for a round multifocal lens with off centered axis.
Figure 17:
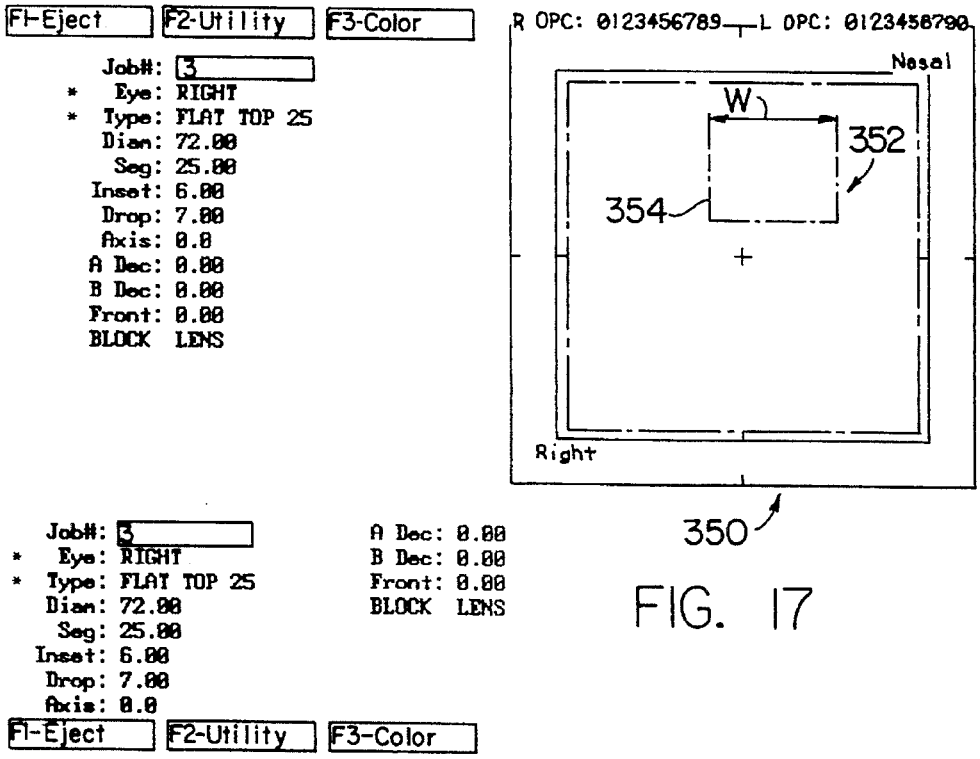
FIG. 17 illustrates a projected target for a flat top multifocal lens.
Figure 18:
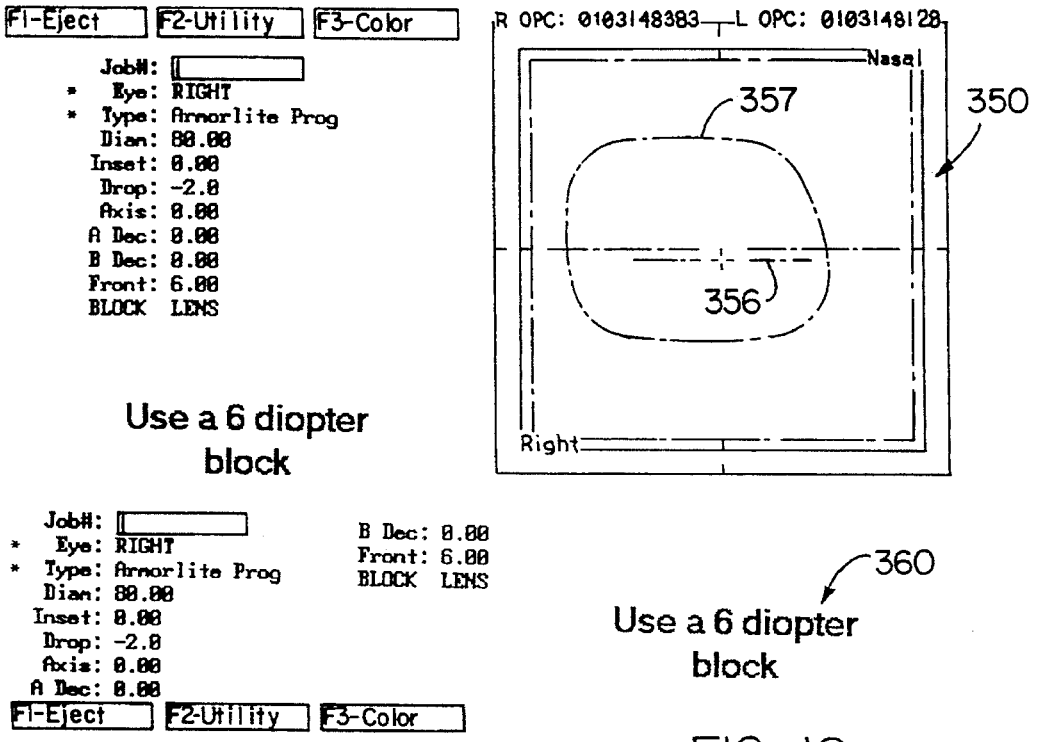
FIG. 18 illustrates a projected target for a progressive lens.

FIGS. 16 and 17 depict how segment length information is used by projecting an open box 352 having a width w defined by a segment length 354 which is used by the computer to project a target area in which the secondary lens is to be aligned. In the case of a progressive lens, the lens is manufactured with reference markings which include crosshair, axis line, and a center dot marking the geometric center of the lens blank and its proper axial orientation. In this case, the graphic display as illustrated in FIG. 18 projects a target line 356 on which is centered the marking for the lens.

Figure 20:
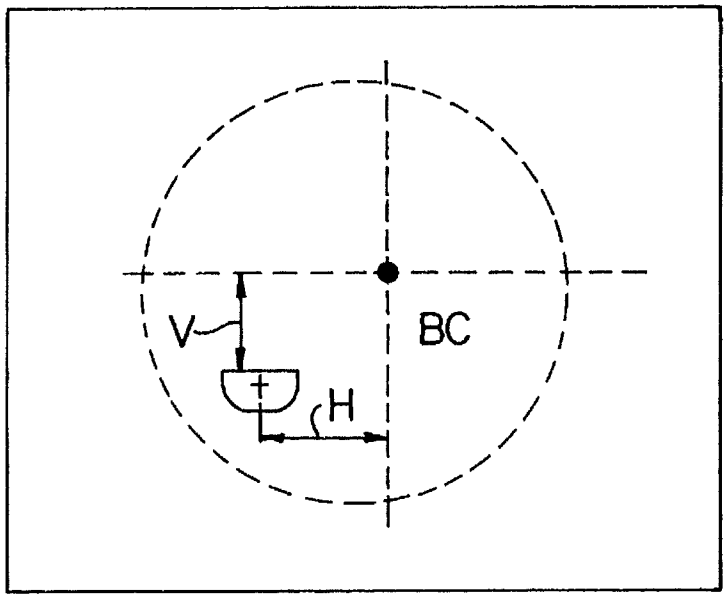
FIG. 20 illustrates decentration and other optical offsets respectively on a lens.

INSET and DROP parameters which are particular to multifocal lenses are next accounted for. As illustrated in FIG. 20, the INSET parameter is the distance H of the secondary lens taken from the center of the blank BC to a reference point usually the horizontal middle of the secondary lens or a vertical marking in the case of a progressive lens. The DROP parameter is the measurement V of the secondary lens from the blank block center BC to either the top edge of the secondary lens in the case of a flat top bifocal or to the horizontal marking in the case of a progressive lens (Step 322). A DECENTRATION and B DECENTRATION which respectively represent vertical displacement and horizontal displacement of the lens center relative to the block center may optionally be provided for the purpose of producing prismatic power. (Step 324)

Figure 19:
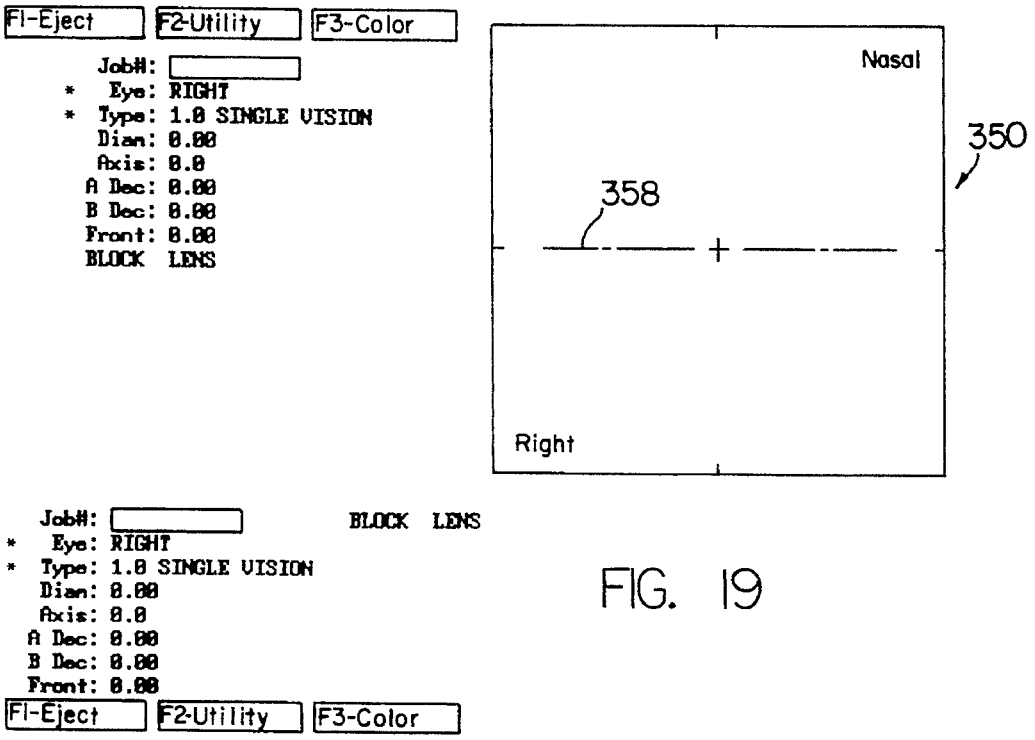
FIG. 19 illustrates a projected target for a single vision lens.

The AXIS parameter is next accounted for. Here, a value for the orientation of a cylinder axis relative to its orientation on the block is determined as between 0 and ±180 degrees. FIG. 19 illustrates a target for a single vision lens with zero AXIS displayed as a simple square with an axis line 358 in a 0 degree position indicating that the cylindrical axis is disposed therealong. (Step 326)

The final parameter check is made with regard to the data entered for the FRONT value describing the curvature outwardly disposed convexed surface 86 of the lens blank. The FRONT value is the curvature in diopters usually provided on the package label of the lens. The FRONT parameter is used in the determination of a desired curvature for the lens block 176. It is desired to obtain generally parallel relationship between the outwardly disposed exterior surface 86 of the lens blank 16 and the opposing surface 173 such that any shrinkage occurring as a result of the blocking material hardening, will occur uniformly throughout the gap G. To these ends the computer using the value for the inputted FRONT parameter compares the value for the FRONT curvature against a series of ranges for the purpose of determining in what range the indicated FRONT value should lie. (Step 328) As illustrated in FIG. 18, the result of this determination is the presentation of a message 360 on the screen indicating that at least in this case Number 4 block is required. (Step 330) The following table is an example of the different block sizes available for a given diopter range for the FRONT curvature of the lens.

| Block Size (Diopters) | Range (Diopters) |
|---|---|
| 2 diopter block | 0.5 to 3.0 |
| 4 diopter block | 3.1 to 5.9 |
| 6 diopter block | 6.0 to 7.9 |
| 8 diopter block | 8.0 to 9.9 |
| 10 diopter block | 10.0 to 12.0 |

With the appropriate block size now determined and the appropriate message at 360 generated, the user then selects the appropriate block size from a selection of blocks that are provided and places it into the blocking ring in the manner previously discussed hereto with reference to FIGS. 14*a* and 14*b*. As further illustrated in FIG. 18, in the case where data is downloaded from a host computer, such information may include a graphic outline 357 of the lens shape as part of the graphic displayed.

Figure 21:
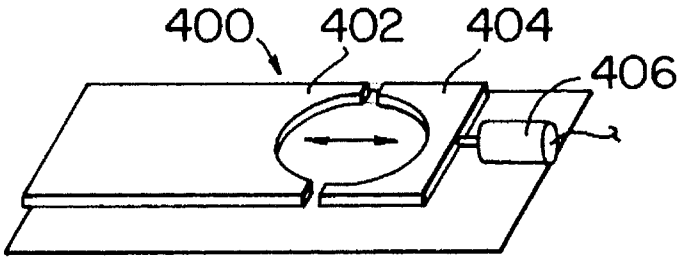
FIG. 21 shows a deblocking device.

After surfacing of the interior surface 84 of the lens blank is accomplished, detaching the block from the lens may be accomplished by providing a deblocking means 400. The deblocking device 400 as illustrated in FIG. 21 is provided and includes two jaw members 402 and 404 one of which jaw members is moveable relative to the other and connected to an actuator 406 moveable between a retracted and an extended position corresponding respectively to the jaws being opened to receive the now blocked lens blank and an extended position wherein a moveable jaw 404 is caused to cleave the bond interface between the outwardly disposed surface 86 and the harden bonding material B. The actuator 406 is connected to a pressurized air source and is caused to move the slidable jaw 404 between its extended and retracted position by the control opening and closing of a valve interposed between the actuator and a pressurized air source along a pressurized air line.

By the foregoing, an automated lens blocking apparatus has been disclosed in the preferred embodiment. However numerous modification and substitutions may be had to the invention without departing from the spirit of the invention. For example, as disclosed the apparatus includes a single blocking station but it is not outside of the purview of the invention to provide a double blocking stations each orientated side by side with one another and extend the length of the way 74 of the pick and place device to accommodate the additional travel needed by the traveler arm 76. Also, the listing of specific lens characteristics which makes up part of the graphic image need not be limited to those disclosed above, but may include other characteristics, such as, any desired PRISM characteristic.

According the invention has been described by way of illustration rather than imitation.

We claim:

1. An apparatus for blocking an ophthalmic lens blank to a block for working the lens comprising:

a base;

means for creating a target image indicating a given desired orientation of a lens blank relative to said base;

an alignment station means supported by said base or supporting a lens blank such that said lens blank is freely movably positionable by an operator relative to said base;

said means for creating a target image being part of a display means for producing a visual display in which said target image is superimposed on an image of said lens blank as supported by said alignment station means whereby by observing said visual display, the operator can move said lens blank on said alignment station means to bring it to said desired position indicated by said target image;

said display means including a light source and means for directing light from said light source toward said alignment station means, and said means or creating a target image including a liquid crystal display device located behind said alignment station means with respect to said light directed toward said alignment station means so that both an image of the shadow cast by said lens blank and said target image can be produced simultaneously and in superposition with one another by said liquid crystal display device;

a blocking station supported by said base for receiving and supporting a block in a given orientation relative to said base;

transport means for moving the lens blank from the alignment station means to the blocking station while maintaining the lens blank orientation established at the alignment station; and said blocking station including a block support for the block, a lens blank support, and a means for injecting heated liquid bonding material between the lens blank and the block which solidifies on cooling to join the lens blank and the block to one another.

2. An apparatus as defined in claim 1 wherein said display means includes a collimating lens means between said light source and said alignment station means for collimating the light directed onto said alignment station means and onto said liquid crystal display device.

3. A method of automatically blocking a lens blank to a block comprising the steps of:

providing an alignment station having a liquid crystal display device with a first generally upwardly facing face and a second generally downwardly facing face, said second face being a display face on which an image can be created and said first face being one to be illuminated;

illuminating said first face of said liquid crystal display device by a light source remote from said first face;

providing a blocking station for supporting a block in a given orientation relative to said base and locating said blocking station remotely of said first face of said liquid crystal display device;

controlling said liquid crystal display device to create a lens blank target image representing a desired position of a lens blank relative to said base;

placing a lens blank between said light source and said first face of said liquid crystal display device so that a shadow of said lens blank is cast onto said first face and an image of said shadow appears on said second face of said liquid crystal display device superimposed on said target image;

moving said lens blank relative to said first face of said liquid crystal display device until reaching a coinciding position at which on said second face said image of the shadow of said lens blank coincides with said target image; and thereafter transporting the lens blank to the blocking station such that it is positioned directly on the block in an orientation relative to said base having a precisely known relationship to the orientation of said lens blank relative to said base when said lens blank is in said coinciding position; and causing the lens blank and block to be bonded to one another at said blocking station by introducing a liquefied hardenable blocking material therebetween.

4. An apparatus as defined in claim 1 wherein said liquid crystal display device is positioned in a substantially horizontal plane, and said display means includes a viewing mirror located generally above the level of said liquid crystal display device and at least one other mirror for reflecting the images produced by said liquid crystal display device onto said viewing mirror for viewing by an operator.

5. An apparatus as defined in claim 4 further characterized by a lens between said liquid crystal display device and said viewing mirror to cause the images produced by said liquid crystal display device and as seen by an operator on said viewing mirror to appear larger than said images as produced at said liquid crystal display device.

6. An apparatus as defined in claim 1 further characterized by a control means connected to said display means for receiving data input related to a specific lens type or prescription and causing an appropriate target image to be created by said liquid crystal display device based on the inputted data.

7. An apparatus for blocking an ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base; and transport means for moving the lens blank from the alignment station to the blocking station while maintaining the lens blank orientation established at the alignment station;

said blocking station including a block support for the lens block, a lens blank support, and a means or injecting heated liquid bonding material between the lens blank and block which solidifies on cooling to join the lens blank and the block to one another; and said transport means including a transport arm having a vacuum controlled suction cup mounted on a ball and socket gripper to engage and hold the lens blank for transport between the alignment station means and the blocking station.

8. An apparatus for blocking an ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base; and transport means for moving the lens blank from the alignment station to the blocking station while maintaining the lens blank orientation established at the alignment station;

said blocking station including a block support for the lens block, a lens blank support, and a means for injecting heated liquid bonding material between the lens blank and block which solidifies on cooling to join the lens blank and the block to one another; and said block support including a water cooled ring which creates a mold cavity for the liquid bonding material and cools the material to solidify it and bond the block to the lens blank.

9. An apparatus for blocking an ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base; and transport means for moving the lens blank from the alignment station to the blocking station while maintaining the lens blank orientation established at the alignment station;

said blocking station including a block support for the lens block, a lens blank support, and a means for injecting heated liquid bonding material between the lens blank and block which solidifies on cooling to join the lens blank and the block to one another; and said blocking station also including a rotatable part having an axis locating pin which engages with a matching hole in the block.

10. An apparatus as defined in claim 9 wherein said blocking station includes a motor drive means drivingly connected to the rotatable part to rotate the block relative to the lens blank in response to prescription related data.

11. An apparatus for blocking on ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base; and transport means for moving the lens blank from the alignment station to the blocking station while maintaining the lens blank orientation established at the alignment station;

said blocking station including a block support for the lens block, a lens blank support, and a means for injecting heated liquid bonding material between the lens blank and block which solidifies on cooling to join the lens blank and the block to one another, said block support including a block support ring; and said blocking station further including a vertical actuator for lowering the block onto the block support ring prior to injecting the bonding material and for lifting the bonded lens blank and block from the support ring when bonding is complete.

12. An apparatus for blocking an ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base; and transport means for moving the lens blank from the alignment station to the blocking station while maintaining the lens blank orientation established at the alignment station;

said blocking station including a block support for the lens block, a lens blank support, and a means for injecting heated liquid bonding material between the lens blank and block which solidifies on cooling to join the lens blank and the block to one another; and said blocking station including a heated nozzle through which the bonding material is directed between the lens blank and block.

13. An apparatus for blocking an ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base; and transport means for moving the lens blank from the alignment station to the blocking station while maintaining the lens blank orientation established at the alignment station;

said blocking station including a block support for the lens block, a lens blank support, and a means for injecting heated liquid bonding material between the lens blank and block which solidifies on cooling to join the lens blank and the block to one another; and said means for injecting heated liquid bonding material including an injection nozzle through which the bonding material is directed between the lens blank and the block, a heated reservoir for holding a supply of liquid bonding material, a pressure chamber communicating with the reservoir through a controlled valve, a passageway for delivery of the bonding material from the pressure chamber to the injection nozzle, and means for controlling the introduction of pressurized air into the pressure chamber for bonding material injection.

14. An apparatus as defined in claim 13 wherein the means for controlling the introduction of pressurized air into said pressure chamber includes a controlled air valve and a control means connected to the air valve to pulse modulate air pressure during the injection process and after injection during the solidification process.

15. An apparatus for blocking an ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base; and transport means for moving the lens blank from the alignment station to the blocking station while maintaining the lens blank orientation established at the alignment station;

said blocking station including a block support for the lens block, a lens blank support, and a means for injecting heated liquid bonding material between the lens blank and block which solidifies on cooling to join the lens blank and the block to one another; and said block including two axis orienting holes on its rear face, one of which holes is elongated to permit entry of a corresponding sized and shaped alignment pin.

16. An apparatus for blocking an ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base; and transport means for moving the lens blank from the alignment station to the blocking station while maintaining the lens blank orientation established at the alignment station;

said blocking station including a block support for the lens block, a lens blank support, and a means for injecting heated liquid bonding material between the lens blank and block which solidifies on cooling to join the lens blank and the block to one another; and said block having an internal gripping feature on its rear face for engagement by said blocking station.

17. An apparatus as defined in claim 16 wherein the blocking station includes a central gripping means to engage the internal gripping feature on the block and pull the block securely into the block support.

18. An apparatus for blocking an ophthalmic lens blank to a block for working the lens comprising:

a base;

means for displaying a target image for a given orientation of a lens blank relative to said base;

an alignment station supported by said base for supporting and aligning a lens blank relative to the target image;

a blocking station supported by said base for receiving and supporting a block in a given orientation relative to said base;

transport means for moving the lens blank from the alignment station to the blocking station while maintaining the lens blank orientation established at the alignment station;

said blocking station including a block support for the lens block, a lens blank support, and a means for injecting heated liquid bonding material between the lens blank and block which solidifies on cooling to join the lens blank and the block to one another; and a sensor positioned on the block support to detect the block in a fully seated position.

19. An apparatus for blocking a prescription lens having an outer surface and an inner surface such that the outer surface of said lens blank is bonded to a block in an orientation relative to the block satisfying prescription data, said apparatus comprising:

a base;

a translucent liquid crystal display device supported on said base and having a first generally upwardly facing face and a second generally downwardly facing face parallel to said first face, said first face being a light input face and said second face being a display face;

a lens alignment station having a lens blank support fixed to said base and disposed above said first face of said liquid crystal device for vertically supporting a lens blank while allowing said lens blank to be moved in directions generally parallel to said first face of said liquid crystal display device;

means for illuminating said first face of said liquid crystal device such that a shadow of the lens blank supported by said lens blank support is cast onto said first face;

means for controlling said liquid crystal device such that there appears on said display face an image of said lens blank shadow and an image of a target to which said lens blank shadow is to be moved, by movement of said lens blank relative to said first face, to achieve a desired orientation of said lens blank relative to said base;

a blocking station disposed on said base and located remotely of said alignment station, said blocking station including a means for receiving a block and seating it in a given orientation relative to said base;

lens blank moving means supported on said base and controllably moveable between said lens alignment station and said blocking station for effecting movement of the lens blank from said alignment station to said blocking station and for placing said lens blank on said block at an orientation having a known relationship to the orientation of said lens blank relative to said base at the start of said movement; and means associated with said blocking station for controllably causing the block and the lens blank to become bonded to one another while the lens blank and the block are each held fixed relative to said base.

20. An apparatus for blocking a lens blank to an associated block comprising:

a base;

a visual display means supported on said base for creating an image used as a target in the positioning a lens blank relative to said base;

a lens alignment means fixed relative to said base for supporting a lens blank relative to said visual display means such that said imaged target and said lens alignment means are substantially superimposed one with the other;

blocking means located remotely of said visual display means for holding a block in a given orientation with respect to said base and for supporting the lens blank above said block such that the lens blank and the block are spaced from one another by a gap extending substantially uniformly between the lens blank and the underlying block;

transport means disposed on said base and being controllably moveable between positions located at the lens alignment means and at said blocking means for engaging with and holding a lens blank supported on said lens alignment means and transporting the lens blank from said lens alignment means to said blocking means and placing said lens blank on said blocking means in the precise orientation in which it was maintained on said lens alignment means;

bonding means associated with said blocking means and including a bonding material capable of being interposed between said gap existing between said lens blank and said block when the lens blank and the block are each simultaneously supported by said blocking means; and control means linked to said visual display means, said blocking means, said transport means and to said bonding means for causing the target image to be displayed on said visual display means, for causing said transport means to controllably move the lens blank from said lens alignment means to said blocking means and for causing said bonding material to be interposed between said lens blank and said block.

21. An apparatus as defined in claim 20 further characterized in that said visual display means includes a display screen for projecting the image of the target and the superimposed lens alignment means; and wherein said lens alignment means supports said lens blank such that the lens blank is freely moveably positionable relative to said projected target.

22. An apparatus defined in claim 21 further characterized in that said visual display means further includes an optical tower and said display screen is a translucent screen which is disposed below said lens alignment means and located within said optical tower;

said optical tower including a mirror system and a radiant energy source located at the top of the tower and direct downwardly through a means for collimating radiant energy emitted from said radiant energy source such that the radiant energy is projected onto the lens alignment means and is passed through said display screen such that a shadow of the lens blank as supported on the lens alignment means is superimposed on the target imaged by the display screen is reflected through the mirror system so as to be capable of being viewed by a user.

23. An apparatus as defined in claim 22 further characterized in that said radiant energy means is a halogen lamp and said mirror system includes a first light redirecting mirror disposed adjacent the halogen lamp for directing light downwardly, a second light redirecting mirror being disposed beneath said display screen and a third light redirecting mirror in line with the second light redirecting mirror and disposed adjacent a viewing mirror for directing the superimposed image onto the viewing mirror for viewing by a user; and a second lens disposed between the second and third light redirecting mirrors for enlarging the projected superimposed image.

24. An apparatus as defined in claim 20 further characterized in that said transport means includes a traveler arm having a gripper means disposed at one end and a journalling part disposed at its opposite other end, said transport means further includes an elongate way extending generally between the lens alignment means and the blocking means about, on which way the journalling part of said traveler arm is engaged.

25. An apparatus as defined in claim 24 further characterized in that said way is supported at opposite ends of said base and said travel arm through said journalling part is pivotal between an upper position corresponding to the gripper means being disposed in a raised condition and a lowered position corresponding to the gripper means being placed into engagement with said lens; and said transport means further including means for causing controlled pivotal rotation of said traveler arm along said way.

26. An apparatus as defined in claim 25 further characterized in that said means for causing controlled pivotal rotation along said way member includes a drive bar extending generally parallel to said way and being held in a spaced relationship therefrom by end blocks journalled about said way at opposite ends thereof;

one of said end blocks being drivingly connected to an actuator means the energization and de-energization of which actuator being controlled by said control means for causing corresponding raising and lowering movements of said traveler arm; and wherein said journalling part of said traveler member includes a torque transmitting cutout correspondingly sized to receive the drive bar such that the journalling part is capable of sliding along said drive bar yet is rotatably coupled to said drive bar.

27. An apparatus as defined in claim 26 further characterized in that said gripper means includes a ball and socket device having a socket part fixedly secured to the free end of said traveler arm, said socket part having an internal cavity communicating with a vacuum source and a passage internally formed within said ball part, said ball part and said socket part being elastically connected with one another by an elongate elastic member fixed at one end to the free end of the traveler arm and secured at its opposite end to the ball part thereby permitting relative engaging movement therebetween; and wherein the ball part and the socket part are engaged along an annular seal and the ball part has a tapered opening communicating with the passage formed in said ball part and a bellows seal disposed around said tapered opening in said ball part for engaging with the opposed surface of said lens blank.

28. An apparatus defined in claim 26 further characterized in that the journalling part of the traveler arm is connected to a toothed endless belt trained about a return pulley rotatably supported on the base and associated with one end of the way and drivingly coupled to a drive sprocket of a drive motor associated with the other end of said way.

29. An apparatus as defined in claim 28 further characterized in that said motor is a stepper motor and said apparatus includes a sensor fixed to said base generally adjacent the end of the way associated with the return pulley such that the traveler arm is initialized to a home position by the stepper motor driving said traveler arm past said sensor such that the sensor detects the presence of travel arm at the sensor location and thereafter allows the control means to count a given number of steps in the stepper motor to locate the traveler arm at a precise first location adjacent the alignment ring and further to locate the travel arm at a precise second location adjacent the blocking means.

30. An apparatus as defined in claim 20 further characterized in that said the blocking means includes a blocking stand supported on said base and said blocking means further includes a reservoir means supporting said blocking stand therein; and wherein said reservoir means includes a heating means for maintaining an otherwise solid bonding material in liquified form.

31. An apparatus as defined in claim 30 further characterized in that said blocking means includes a blocking ring defined a generally upwardly extending annular edge and having a frustoconical interior surface ending in a shouldered opening within the interior confines of said ring; and wherein said shouldered opening includes a rotatable positioning means for engaging with said block and orientating it at a prescribed angular orientation relative to said base.

32. An apparatus as defined in claim 31 further characterized in that said rotatable positioning means includes a rotatable part journalled within said blocking stand and having a locating pin disposed radially outwardly of its rotational center and driven by a stepper motor supported on said stand and connected to said control means for rotating the block angularly relative to said blocking stand.

33. An apparatus as defined in claim 32 further characterized in that said rotatable positioning means has a central rotation axis and said rotatable part is journalled within said blocking stand concentrically with said central rotatable axis, and said rotatable positioning means including a vertical actuator means having an elevator rod moveable between an extended position and a lowered position corresponding respectively to the placement of the block on the blocking ring and the subsequent lowering of the block into the blocking stand when the block and the lens blank are undergoing a blocking operation.

34. An apparatus as defined in claim 33 further characterized in that said blocking ring is a generally toroidal member having a hollow interior passage communicating with an inlet and an outlet opening;

said inlet opening being connected to a chilled water source and said outlet being connected to the chilled water source so as to the return chilled water from the interior passage after passing through said blocking ring.

35. An apparatus as defined in claim 30 further characterized in that said blocking stand includes a chamber disposed at its lower end and includes an inlet disposed at the base of the blocking stand communicating with the liquefied bonding material in said reservoir;

said blocking stand further includes a fluid passage running internally from said chamber upwardly to said gap between said lens blank and block; and said chamber includes a gate means and includes an air pressurized means for causing the chamber to become pressurized once said gate means is closed thereby causing the liquefied bonding means to be forced up the fluid passage and outwardly to said gap.

36. An apparatus as defined in claim 35 further characterized by means defining on injector port between said fluid passage in said blocking stand and said gap between said lens blank and block.

37. An apparatus as defined in claim 35 further characterized in that a heating element is provided around said injection port to maintain the blocking material in a liquified state while being surrounded by chilled water; and wherein said blocking stand further includes cartridge heaters for maintaining the bonding material within the chamber in liquified form.

38. An apparatus as defined in claim 32 further characterized in that said rotatable positioning means includes a sensor for indicating an initial position and said stepper motor is caused to rotate a given number of steps as defined by a prescribed angular orientation for the rotatable part as set forth by the control means.

39. An apparatus as defined in claim 20 further characterized in that said blocking means includes a sensor for determining proper seating of the block.

40. An apparatus as defined in claim 39 further characterized in that said sensor is disposed substantially annularly about the shoulder of said opening, said sensor being comprised of first, second and third arcuate metallic segments each facing upwardly toward and providing a seat engaged by the blocking ring;

circuit means connected to each of said three arcuate segments for determining whether the block is flushly seated in said shouldered opening and for causing the control means to indicate that such flush seating has or has not been accomplished; and each of said arcuate segments is connected to an individual lead having a separately applied voltage source, said leads each being connected to a peak detector having a means for determining the maximum voltage potential between each of the first, second and third arcuate segments at any given time and the respective applied voltage source for each of the three arcuate segments.

41. An apparatus as defined in claim 40 further characterized in that said peak detector includes three diodes each having input ends connected respectively between the respective applied voltage sources and the corresponding arcuate segments, each of said diodes having an output line connected in parallel to one another such that the highest voltage potential existing in each of the first, second and third arcuate segments causes reverse biasing of the remaining diodes.

42. An apparatus as defined in claim 41 further characterized in that the output of said peak detector is connected to the input lead of a comparator having a given threshold voltage corresponding to a prescribed acceptable distance existing between each of the first, second and third arcuate segments and the base surface of the block; and wherein said control means recognizes a LOGIC 1 condition as being indicative a voltage potential in one of said first, second and third segments which is acceptable corresponding to the base surface of the block being properly seated within the shouldered opening, and a LOGIC 0 condition corresponding to an unacceptably high voltage potential in one of said first, second and third segments corresponding to the condition where the block is not properly seated within said shouldered opening.

43. An apparatus as defined in claim 42 further characterized in that disposed directly below each of said first, second and third arcuate segments is a second identical set of plate segments each having separate leads connected respectively to a voltage follower circuit having an input end connected between the respective ones of the arcuate upper segments and the respective applied voltage sources connected to each of said upper arcuate segments.

44. An apparatus as defined in claim 20 further characterized in that said blocking means includes a seating means for engaging a block and pulling it into seating engagement with a block support.

45. An apparatus as defined in claim 44 further characterized in that said seating means includes a placement disc having two gripper arms each pivotally connected to one another in a sissors-like manner, each of said arms having a portion which extends outwardly beyond the disc to engage the back portion of the block.

46. An apparatus as defined in claim 45 further characterized in that said disc includes first and second biassing means each separately controllably acting on the gripper arms to cause the outwardly extending portions thereof to come together or separate.

47. An apparatus as defined in claim 46 further characterized in that said disc is drivingly connected to an actuator means for moving the disc between extended and retracted positions to cause the action of the first and second biassing means to cause the arms to come together when in the disc is moved to an extended condition and to be spread apart when the disc is moved to a retracted condition.

48. An apparatus as defined in claim 47 further characterized in that said arms create an arrow-like member when drawn together.

49. A method as defined in claim 33 further characterized by creating said image on said second face of said liquid crystal display device from parameters describing the characteristics of the lens and prescription.

50. A method as defined in claim 49 further characterized in that said parameters include the diameter of the lens to be cut, the characteristics of the segment of the secondary focal lens if any, and the inset and drop amounts of the vertical and horizontal decentration of the optical center of the lens.

51. A method as defined in claim 50 further characterized by said characteristics of the amount of the secondary focal lens including the size of the segment, and using the size of the segment to project a locating box for the segment as part of the target image.

52. A method as defined in claim 51 further characterized by causing the target image to take the form of a generally rectangular box within which the image of the shadow of the lens blank is to be positioned to achieve said desired position of said lens blank relative to said base.

53. A method as defined in claim 52 further characterized by creating as part of said target image an image of the shape of the lens to be produced.

* * * * *